US006736303B2

(12) United States Patent
Bruins et al.

(10) Patent No.: US 6,736,303 B2
(45) Date of Patent: May 18, 2004

(54) MOBILE FASTENER DRIVER TOOL

(75) Inventors: Roger C. Bruins, Hudsonville, MI (US); Roger A. Vanden Berg, Jamestown, MI (US)

(73) Assignee: National Nail Corp., Grand Rapids, MI (US)

( * ) Notice: Subject to any disclaimer, the term of this patent is extended or adjusted under 35 U.S.C. 154(b) by 0 days.

(21) Appl. No.: 10/146,778

(22) Filed: May 16, 2002

(65) Prior Publication Data

US 2003/0213829 A1 Nov. 20, 2003

(51) Int. Cl.[7] ..... B27F 7/02

(52) U.S. Cl. ..... 227/99; 227/110; 227/114; 227/119; 227/120

(58) Field of Search ..... 227/15, 16, 18, 227/99, 110, 114, 119, 120, 130, 135, 136, 138, 149

(56) References Cited

U.S. PATENT DOCUMENTS

| | | | | |
|---|---|---|---|---|
| 2,385,521 A | * | 9/1945 | Mead | 144/250.26 |
| 3,173,593 A | * | 3/1965 | Elliott | 227/111 |
| 3,796,365 A | * | 3/1974 | Downing | 227/8 |
| 3,935,983 A | | 2/1976 | Buttriss | |
| 3,984,040 A | * | 10/1976 | Fry | 227/7 |
| 4,036,422 A | * | 7/1977 | Harvey | 227/110 |
| 4,084,738 A | * | 4/1978 | Schneider | 227/7 |
| 4,246,939 A | | 1/1981 | Boegel | |
| 4,657,167 A | | 4/1987 | Mays | |
| 4,732,307 A | * | 3/1988 | Hubbard et al. | 227/7 |
| 4,870,750 A | | 10/1989 | Zahn | |
| 5,042,142 A | | 8/1991 | Beach et al. | |
| 5,056,684 A | | 10/1991 | Beach et al. | |
| 5,125,552 A | * | 6/1992 | Medwed | 227/156 |
| 5,347,707 A | | 9/1994 | Beach | |
| 5,555,780 A | | 9/1996 | Beach et al. | |
| 5,584,415 A | | 12/1996 | Beach et al. | |
| 5,634,583 A | | 6/1997 | McGuinness et al. | |
| 5,749,508 A | * | 5/1998 | Clothier | 227/7 |
| 5,947,362 A | * | 9/1999 | Omli | 227/120 |
| 6,064,189 A | * | 5/2000 | Frankel | 324/67 |
| 6,269,996 B1 | | 8/2001 | McAllister | |
| 2001/0050301 A1 | | 12/2001 | McAllister et al. | |

FOREIGN PATENT DOCUMENTS

| | | |
|---|---|---|
| WO | WO9939878 | 8/1999 |

* cited by examiner

*Primary Examiner*—Scott A. Smith
*Assistant Examiner*—Nathaniel Chukwurah
(74) *Attorney, Agent, or Firm*—Warner Norcross & Judd LLP

(57) ABSTRACT

A fastening system for driving fasteners through fastener caps. The fastening system includes a nail gun, an actuator system and a fastener cap dispenser, all mounted on a rolling chassis. The actuator system includes a wheel and an actuator in communication with the nail gun. As the wheel rotates, it intermittently engages the actuator which in turn fires a nail along a path. Drive air from the nail gun is vented to the fastener cap dispenser, which dispenses a fastener cap. In a preferred embodiment, the dispenser includes a picker including two pairs of movable teeth that engage two sides of two adjacent fastener caps to feed the fastener caps at high speeds. In a more preferred embodiment, the fastening system includes a fastener cap regulator that provides a constant feed of fastener caps to the dispenser, thereby preventing jamming of the same.

22 Claims, 19 Drawing Sheets

MOBILE FASTENER DRIVER TOOL

BACKGROUND

The present invention relates to fastener applying equipment, and more particularly to nailers for the application of roofing fasteners.

Roofs for commercial or industrial buildings typically are flat and cover a significant area. Two preferred materials for constructing the substructure of large flat roofs, or the "deck," are steel and wood. Steel is preferred in regions of the country subject to significant snow accumulation because of its strength and ability to withstand snow loads. Wood is preferred in regions with little or no snow accumulation, and possibly where structures may be subject to significant vibration during earthquakes. Wood is able to flex under such vibration without breaking or permanently deforming.

Wood deck roofs are typically weather-proofed to keep out the elements. To do so, the deck is covered with multiple layers of "felt" (i.e., a thin sheet of water-impervious material), asphalt and sealer. This type of roof is called a built-up roof, or "BUR." In constructing a BUR, felt is first secured to the wood deck and then multiple layers of tar and asphalt are laid over the felt. The exact number of layers depends on the architect's (building owner's) specification or local building code specifications.

To secure felt to the wood deck, fasteners, such as staples or nails, are driven through the felt into the wood. In many regions of the country, building codes require the felt to be fastened regular intervals, for example, every 9 or 18 inches. The intervals depend on whether one sheet of felt is fastened directly to the deck or whether two overlapping sheets of felt are fastened to the deck along a seam. The number of fasteners required for a single roof may range from 1 to 5 million, depending on the size of the roof and the specifications.

Conventionally, fasteners are driven through the felt and into the wood deck in one of two ways. In one way, roofing nails are manually driven through the felt and into the deck. This method becomes costly because it requires many man-hours to drive millions of nails.

In the other way, a device called a "base tape stapler" is used. The base tape stapler unrolls a strip of tape over the felt and drives staples into the wood deck, straddling the tape, at regular intervals. FIG. 1 shows a base tape stapler 10 including a pneumatic stapler 11 mounted on a frame 12 with rollers 14. The base tape 6 is wrapped on a spool of tape 7 and guided toward the stapler 10 within slot guides 16. The base tape stapler also includes an actuator system 20 that includes a roller 14*a* having a bolt 22 that regularly engages a switch 24 as the roller rotates and the bolt 22 bumps the switch.

In operation, the base tape 6 must be threaded though guide slots 16 and initially stapled or held against the deck in starter region 2*a* with multiple staples. This is to provide a fixed end of the base tape 6 so that as the base tape stapler 10 is pushed away from the starter region 2*a*, the supply of tape 7 is unrolled and fed through slot guides 16, under the staple barrel 13, which includes a driving blade (not shown). As the roller 14*a* rotates, the bolt 22 engages the switch 24 causing stapler 11 to drive the driving blade downward to engage and drive staples at regular intervals through the felt 4, into the wood deck 8, straddling the base tape 6, and pressing it down against the felt 4. As a result, the felt under the base tape between adjacent staples is held down by the base tape to increase the holding area of the staples.

Although base tape staplers provide a way to fasten felt to a large wood deck, they suffer several shortcomings. First, base tape staplers easily drive staples into conventional, multi-layer plywood decks, but they fail to drive staples well into newer, more dense, wood decks constructed from OSB board. Accordingly, the holding power of the staples is diminished because they are not driven very far into the OSB.

Second, it is imperative that the base tape stapler avoid contacting and nicking the base tape with driven staples to prevent tears in the tape. However, this objective is rarely met if the deck is uneven because the stapler becomes tilted and shoots staples at an angle toward the base tape, and usually directly into the base tape. Thus, in many cases the base tape stapler must be stopped and the tape restarted so that it is properly laid. This results in costly down time.

Third, the base tape must be pulled through the guides of the stapler by first securing the tape to the deck. This delays start-up time and thus operating time for the base tape stapler.

Fourth, the base tape stapler only lays tape in straight lines. To turn the stapler and begin laying tape in another direction, the tape must be severed, the machine turned in the new direction, and the base tape secured again to the deck in another starter region.

Fifth, the driver blades of the base tape stapler frequently break due to the significant forces required to drive staples. Replacement of the blade reduces operating time and increases operating costs.

Finally, voids are created under the tape between staples when the next layer of the BUR is applied over the felt because nothing holds the tape tightly against the felt in the areas between the staples. With these voids, any movement in the layers above the felt layer due to heat expansion or cold contraction may cause movement between the built-up layers and the felt. This movement may cause the felt to tear. Furthermore, moisture may be captured in the voids between the tape and felt, which can lead to decay of the felt and/or underlying wood deck.

SUMMARY OF THE INVENTION

The aforementioned problems are overcome in the present invention in which a walk-behind rolling nailer drives nails through fastener caps at regular intervals.

In a first aspect of the invention, the fastening system includes a wheeled chassis, a nail gun, an actuator system, and a fastener cap dispenser. The nail gun is mounted on the chassis, which includes rollers and an actuating wheel. A mechanism for communicating with the actuator system at regular intervals is mounted on the actuating wheel. This mechanism may include, for example, bumps, recesses, photo detectable elements, laser detectable elements, machine readable code, or the like. The actuator system includes an actuator aligned with the mechanism and in communication with the nail gun. The actuator is capable of sensing or communicating with the mechanism. As the wheel rotates, the mechanism engages the actuator to fire the nail gun. The actuator system also actuates the fastener cap dispenser, so that as the nail gun fires a fastener through one fastener cap, the dispenser dispenses another fastener cap in the driving path of the nail gun.

In a first variation of the first aspect, the fastener caps are sequentially arranged, or collated, on a strip of material and the fastener cap dispenser system is configured to feed the fastener caps. To do so, the fastener cap dispenser includes a reciprocating "picker" including four teeth that simultaneously engage and advance two sequential fastener caps on the collated strip of fastener caps toward the drive path of the nail gun. Preferably, two of the four teeth engage opposite sides of one fastener cap and the other two teeth engage opposite sides of another fastener cap. The picker may also include one or more anti-backup teeth or devices to prevent the collated fastener caps from backing-up as it reciprocates.

In a second variation of the first aspect, the wheel includes several mechanisms for communicating with the actuator system, and the actuator system includes several corresponding actuators, as well as a control system. The additional mechanisms are positioned at different regular intervals on the wheel. With the control system, the user can select different intervals at which he wants to drive fasteners as the fastening system is moved.

In a third variation of the first aspect, the control system is operable in either an automatic mode, wherein the fastening system discharges nails automatically at the regular intervals, or a manual mode, where the user may manually fire the nail gun.

In a second aspect of the invention, the fastening system includes an accumulator that prevents excess fastener caps from being fed too quickly to the dispenser and jamming it. The accumulator is positioned downstream from a spool of fastener caps, and upstream of the dispenser. A strip of fastener caps drapes across the accumulator. If the spool unwinds too quickly, the accumulator prevents advancement of excess caps toward the dispenser. The excess caps are temporarily stored in the accumulator.

In a third aspect of the invention, the nail gun is outfitted with an exhaust shield that deflects exhaust air from the nail gun, away from the other components of the fastening system so that oil, typically included in such exhaust air, does not contaminate those components.

The fastening system of the invention offers many benefits. First, it provides a quick and efficient way to fasten roofing or other material to a large deck by driving independent fasteners through associated fastening caps and into the deck. With the relatively small size of fastening caps, the number of voids between the fastener and the secured material is minimized.

Second, with the independence of each dispensed fastener/fastening cap unit, or "fastening unit," fastening felt down is initiated simply by rolling the fastening system or actuating it in manual mode. Moreover, the fastening units allow a user to turn the fastening system without stopping.

Third, with the picker of the fastening system, fastener caps may be fed at high speeds with minimal jamming in the picker due to the multiple contact points on multiple fastener caps.

Fourth, the accumulator bin prevents fastener caps from jamming in the picker.

Fifth, the fastening system offers users the option of selecting between different fastener discharge intervals, as well as operation between an automatic nailing mode and a manual nailing mode on the fly.

These and other objects, advantages and features of the invention will be more readily understood and appreciated by reference to the detailed description of the preferred embodiments and the drawings.

DETAILED DESCRIPTION OF THE INVENTION

I. Overview

Figure 8:
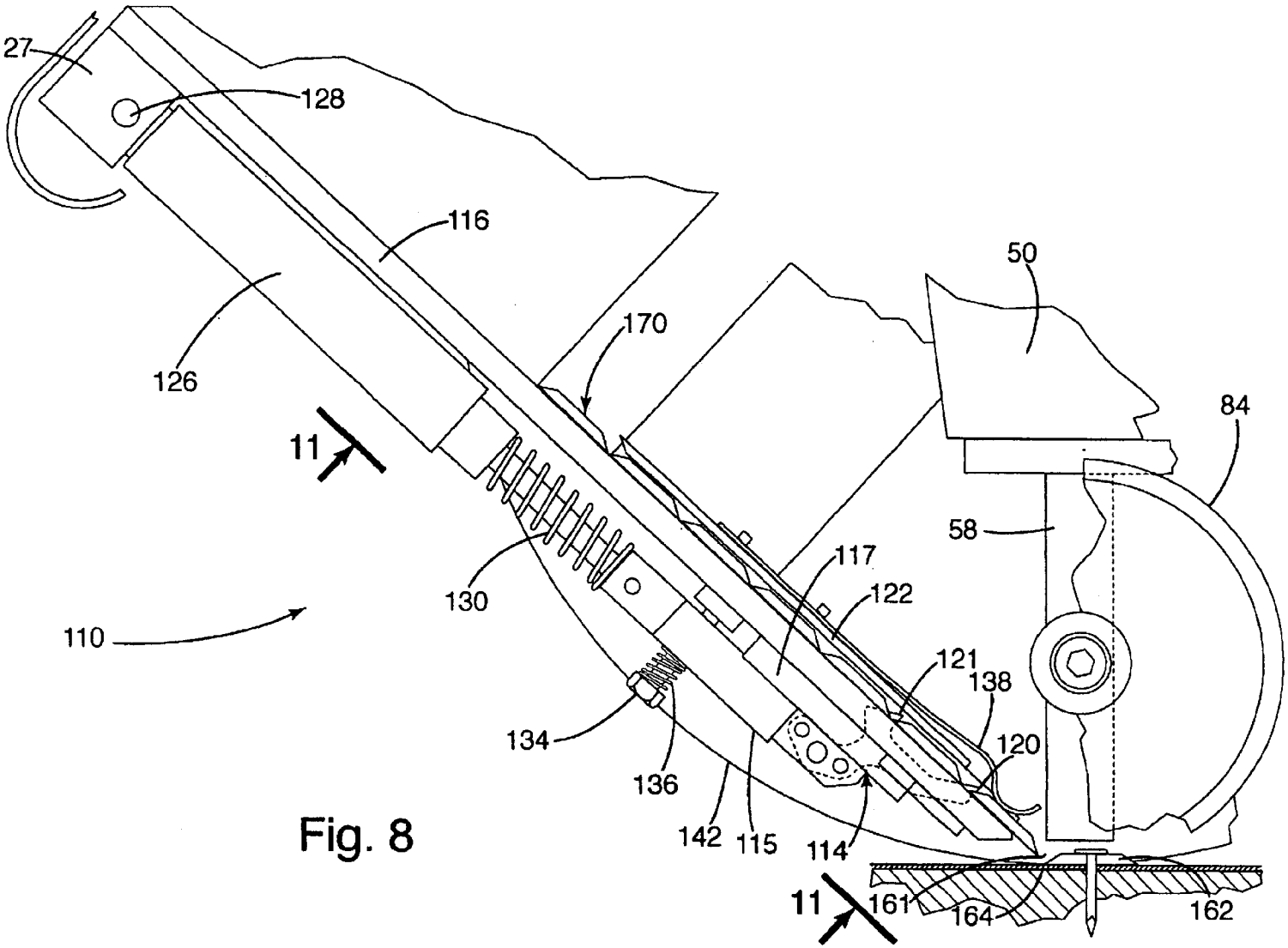
FIG. 8 is a right side elevational view of a picker of a fastener cap dispenser of the present invention in an extended position.

A fastening system constructed in accordance with a preferred embodiment of the invention is illustrated in FIGS. 2–6 and generally designated 30. The fastening system includes a fastener driver 50, a chassis 70, an accumulator 90, a fastener cap dispenser 110, and an actuator system 140. A spool of fastener caps 160 and a magazine of fasteners 180 are mounted to the chassis 70, and fed to the fastener cap dispenser 110 and to the fastener driver 50, respectively. The actuator system includes an actuator wheel 142 having actuator mechanisms or elements 144*a* and 144*b* which are in communication with actuators 146*a* and 146*b*, respectively. The actuators are in further communication with a trigger actuator 56 coupled to the fastener driver 50. The fastener driver 50 is in communication with dispenser 110. To operate the fastening system, a user pushes it along a surface. In doing so, the actuator wheel 142 rotates and the elements 144*a* and 144*b* communicates with and engages the trigger actuator 56. In a turn, the fastener driver 50 fires a fastener out its barrel 58 driving the fastener along a path through a fastener cap positioned in the path and into a substrate (FIG. 8). In a synchronized manner, the dispenser 110 positions another fastener cap into the drive path of the nail gun. After the fastener is driven through the fastener cap into a substrate, the fastener cap holds felt, foam or other material against the substrate.

A. Fastener Driver

The fastener driver 50 of the fastening system 30 will now be described in detail with reference to FIGS. 2, 3, 3A and 14. The fastener driver 50 of the preferred embodiment is a pneumatic nail gun including a trigger assembly 54 having a trigger actuator 56 mounted thereto. A fastener driver suitable for use with the present invention is a Hitachi Model NV50A1 coil nailer available from Hitachi Koki of Tokuyo, Japan. The fastener driver 50 preferably is bolted to fastener driver mount plate 76 of the chassis 70. Nails are fed from the nail magazine 180 to the barrel 58 of the fastener driver 50 in a conventional manner. The fastener driver drives nails from its barrel 58 along a path parallel with the barrel 58.

Pressurized and preferably regulated air is supplied to the fastener driver through pressure regulator 60. In a preferred embodiment, the operating pressure of the nail gun is about 90 to about 100 pounds per square inch (psi) and more preferably, 95 psi. This pressure offers adequate driving force to drive a nail into a substrate without damaging the fastener caps that the fastener pierces. The pressure regulator is in fluid communication with an air supply (not shown) via airline 62.

Figure 14:
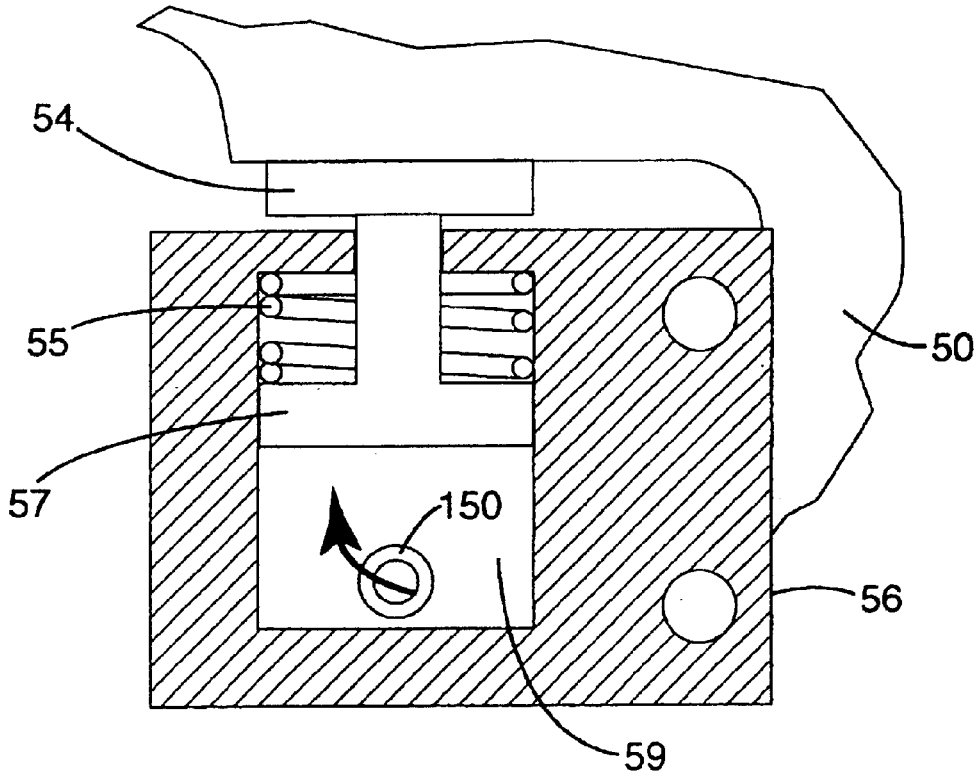
FIG. 14 is a cross-sectional view of a trigger valve of the actuator system.

In FIG. 14, the trigger assembly 54 of the fastener driver 50 is in mechanical communication with the trigger actuator 56. The trigger actuator defines a cavity 59 in which a plunger 57 is biased by spring 55. The plunger 57 is in engageable against the trigger assembly 54. When air from an actuator (described below) is discharged into the trigger actuator 56, that air enters into the cavity 59 via trigger actuator inlet 150 and pushes the plunger 57 against the trigger assembly 54, to fire the fastener driver 50. After the burst of air passes by the plunger 57, spring 55 decompresses and disengages the plunger 57 from the trigger assembly 54 until another burst of air enters the cavity 59.

Figure 1:
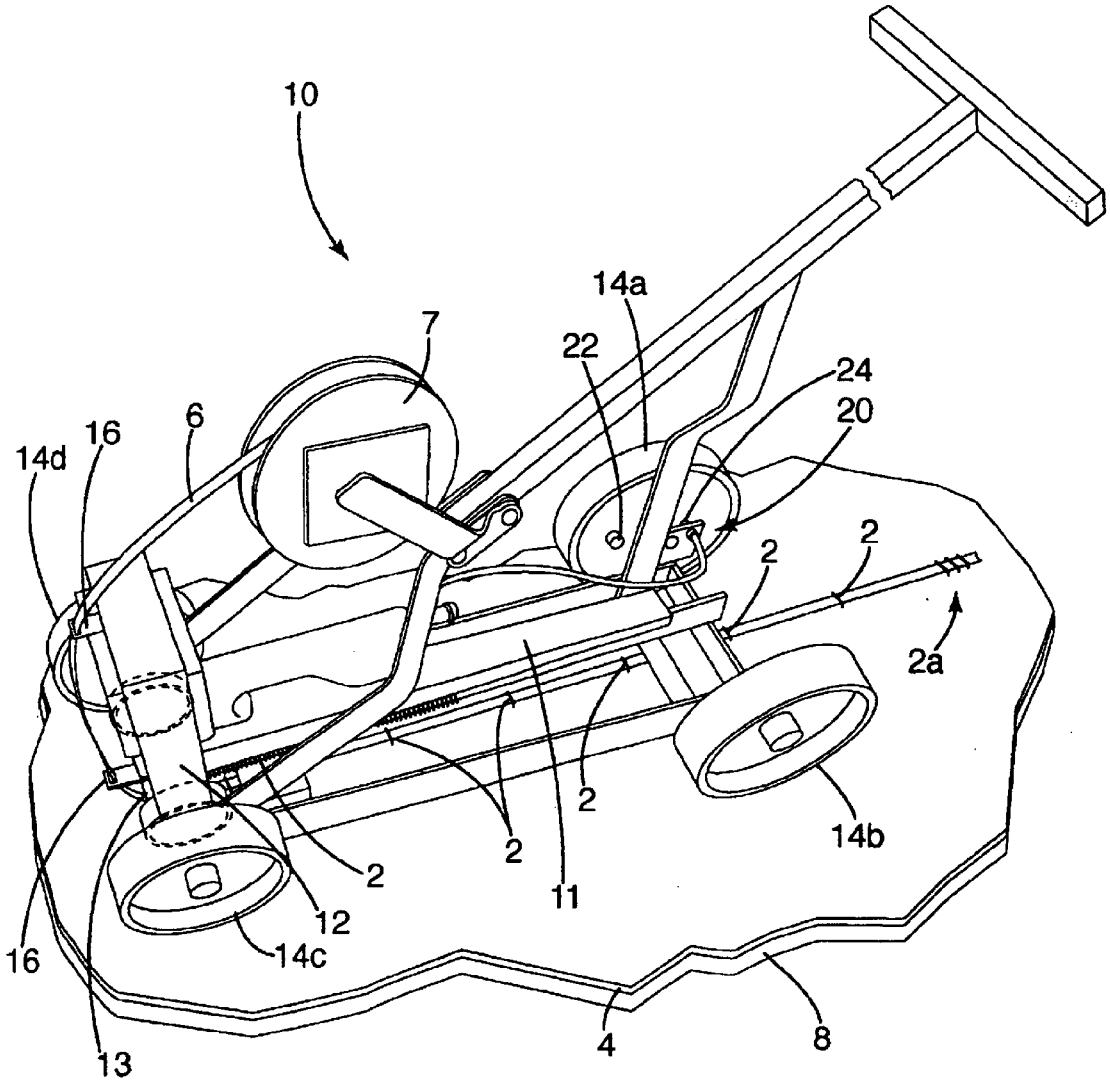
Fig. 1 (Prior Art)
FIG. 1 is a perspective view of a base tape stapler of the prior art.
Figure 2:
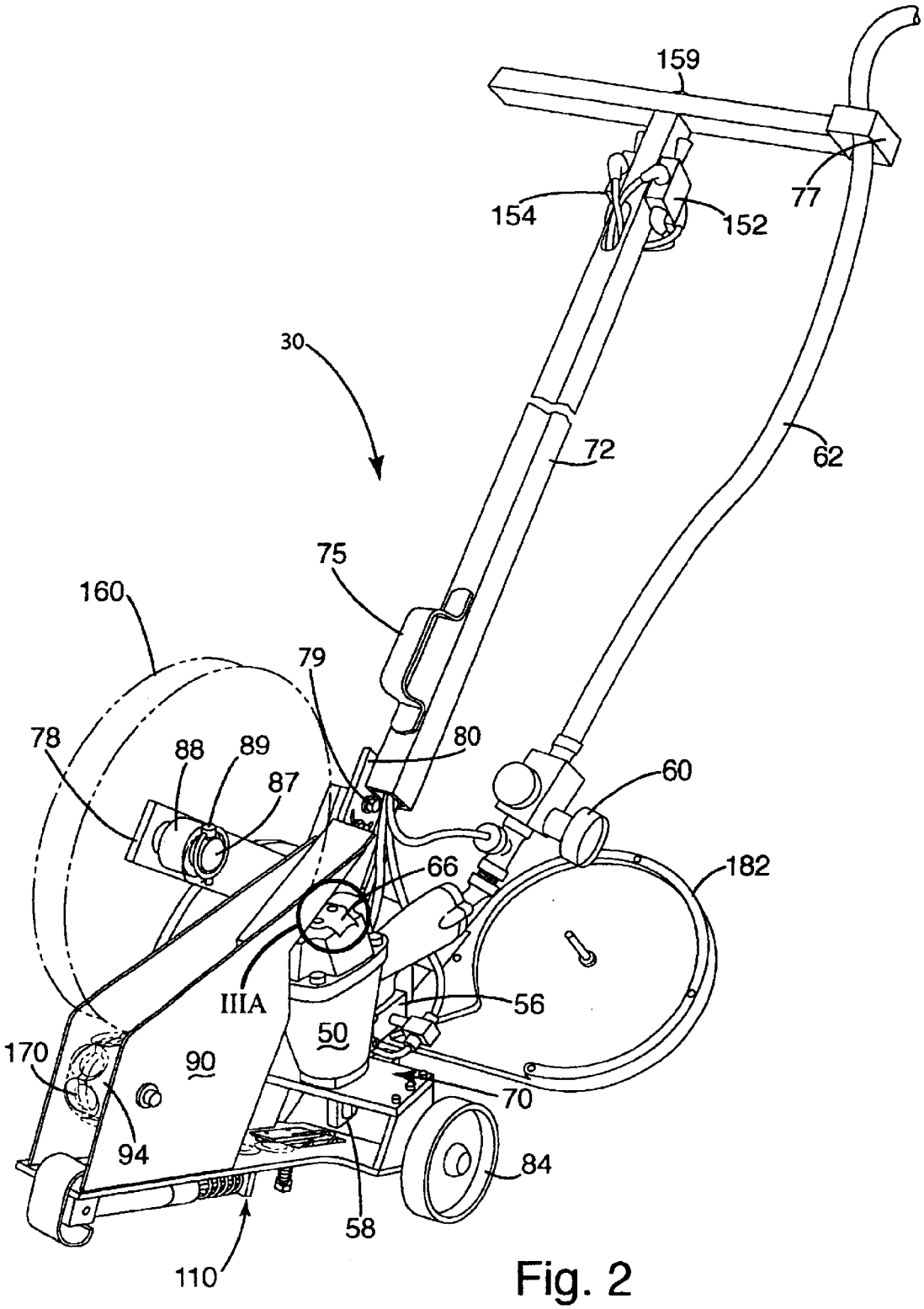
FIG. 2 is a perspective view of the fastening system of the present invention.
Figure 3:
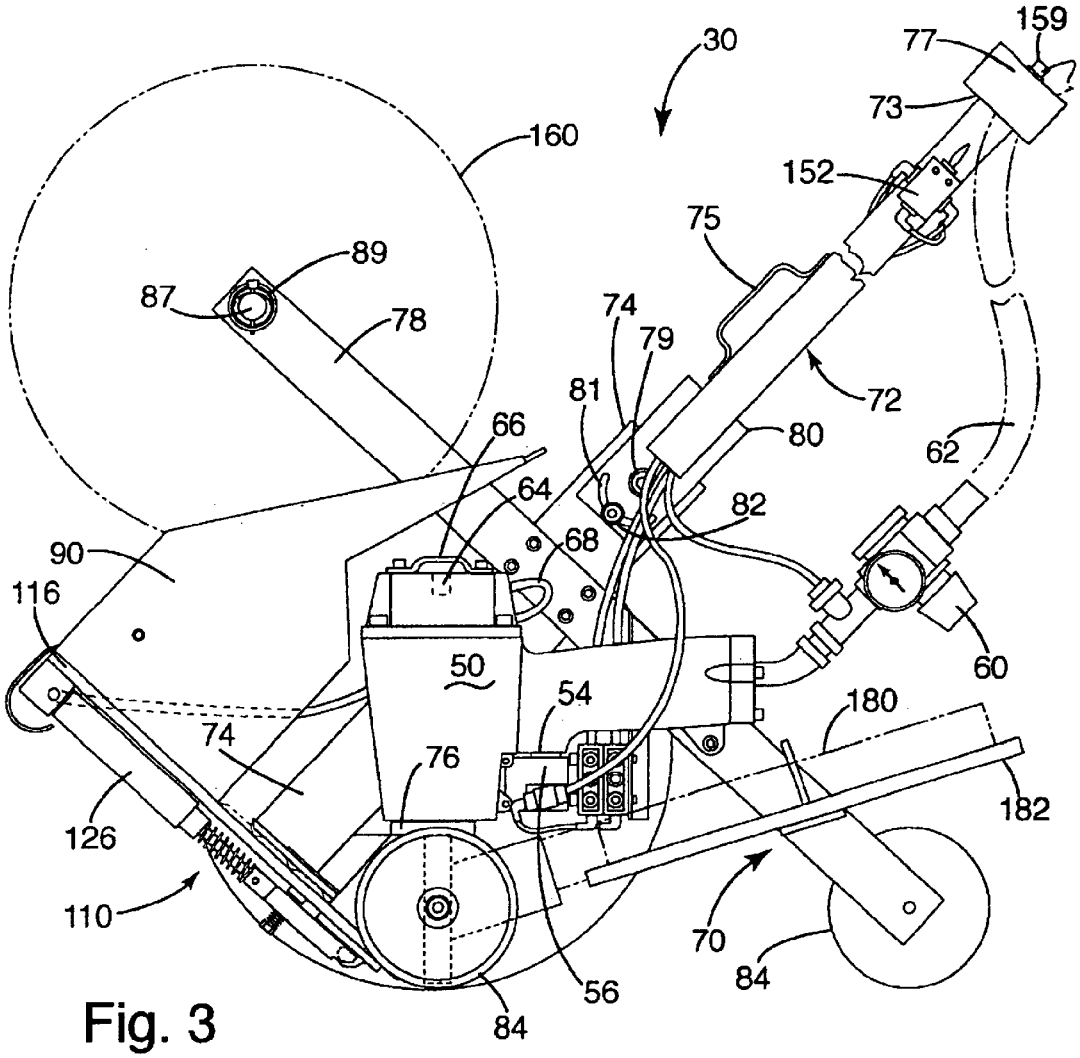
FIG. 3 is a left side elevational view of the fastening system.
Figure 3A:
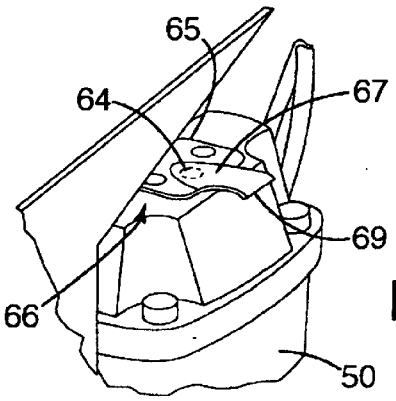
FIG. 3A is a detail of an exhaust shield of the present invention taken from FIG. 2.

With reference to FIGS. 2, 3 and 3A, the fastener driver 50 includes an optional exhaust shield 65. After drive air drives a fastener through the barrel 58 of the gun 50, exhaust air is vented through an exhaust air vent 64. In high volume applications, this air may include oil. If not directed away from the moving parts of the fastening system, for example, the fastener cap dispenser 110, the actuator system 140 and the accumulator 90, this oil-laden exhaust air is expelled onto these components, coating them with oil. This increases debris, for example, sand, accumulation on the components and increases friction and wear. Accordingly, with the exhaust shield 66, the exhaust air from the exhaust air vent 64 is deflected away from the other components of the fastening system 30. The exhaust shield includes a plate 65, which is bolted to the fastener driver 50. The plate defines a channel 67 which vents the exhaust air away from the other components of the fastening system. The channel may include a deflector 69 adjacent the end of the channel 67 to deflect the exhaust air towards the ground.

Figure 18:
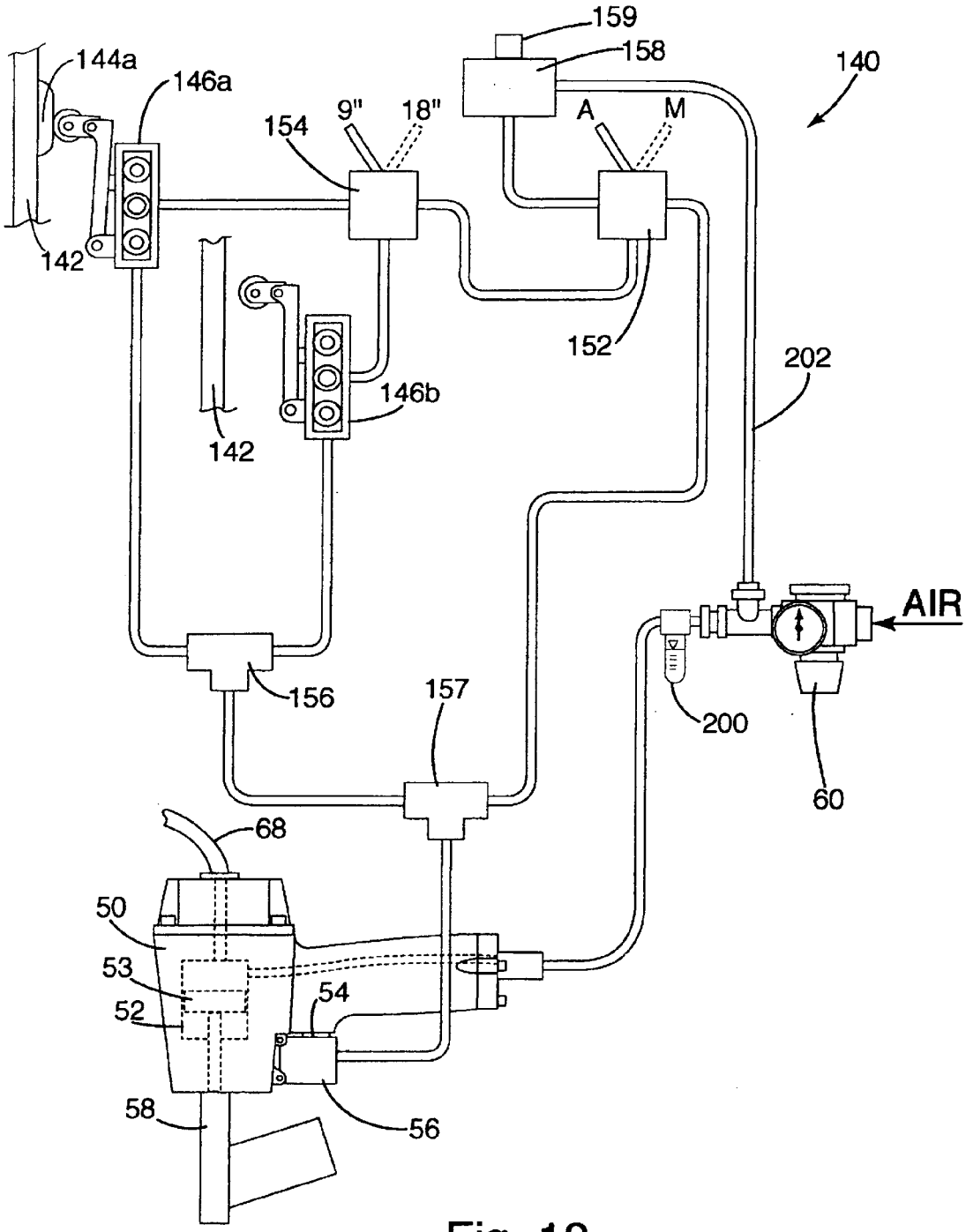
FIG. 18 is a schematic of an alternative embodiment of an actuator system including a lubricator.

The fastener driver 50 also is outfitted with a drive air diverter 68 which diverts drive air from the fastener driver 50 during a driving operation to the drive cylinder 126 of the fastener cap dispenser 110, as described in further detail below. The drive air diverter 68 is in fluid communication with an internal cylinder 52 of the fastener driver 50 (FIG. 18). A portion of the drive air used to drive driving piston 53 of the fastener driver 50 within the internal cylinder 52 may be transferred to the diverter 68 as a fastener is driven from barrel 58.

Although the preferred fastener driver 50 is a pneumatic air gun, other fastener drivers, such as exploding cap drivers, propane or gas drivers, electric drivers, and the like may be used as desired.

B. Support Chassis

With reference to FIGS. 2–6, the support chassis 70 or frame of the fastening system 30 will now be described. The chassis 70 generally includes a handle 72, a first frame member 74 and a second frame member 78. The support chassis also includes rollers 84, which may be substituted with casters, skis, wheels or track as desired. Moreover, the wheels may be powered by a secondary power source (not shown).

The handle 72 generally includes a gripping bar 73, a carry handle 75 and a hose guide 77, which guides air line 62 up and away from the rollers 84 to allow for easy manipulation of the fastening system 30. The handle 70 is preferably hollow to allow air lines of the actuator system 140 (described below) to be concealed. The handle 70 is secured to a coupler plate 80, which is secured to the first member 74 with a coupling bolt 79. The plate 80 defines an angular adjustment slot 81 in which angle adjuster bolt 82 rides and may be secured to adjust the angle of the handle 70 relative to the frame member 74.

Figure 4:
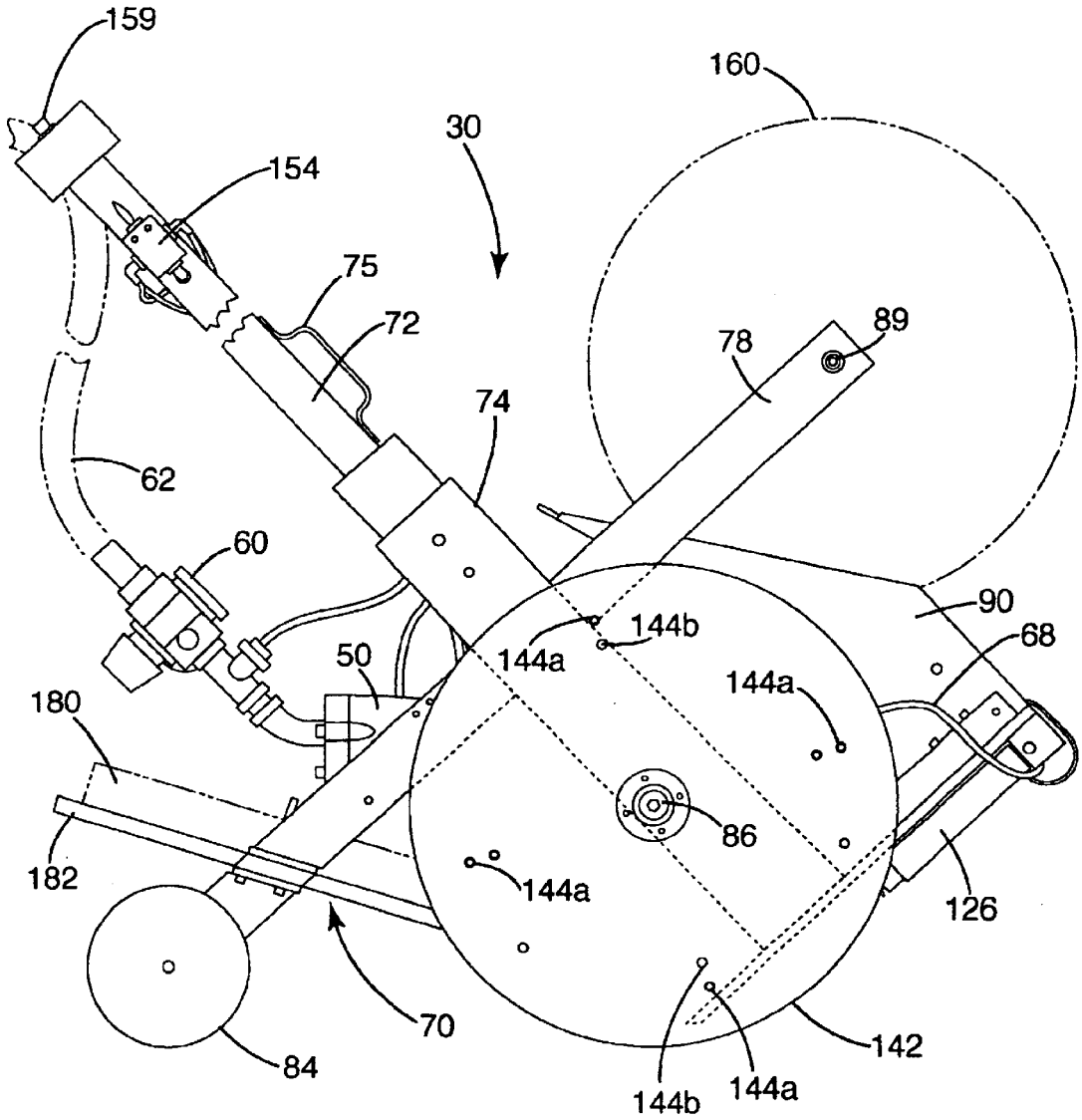
FIG. 4 is a right side elevational view of the fastening system.

With particular reference to FIGS. 3 and 4, the first member 74 is secured to the second member 78 with bolts, screws, welds or other conventional fastening means. The first member 74 has secured thereto a mounting axle 86 to rotatably mount the actuator wheel 142 to the chassis 70. The first member extends and is secured to the picker plate 116, which forms a portion of the fastener cap dispenser 110 as described below.

Figure 5:
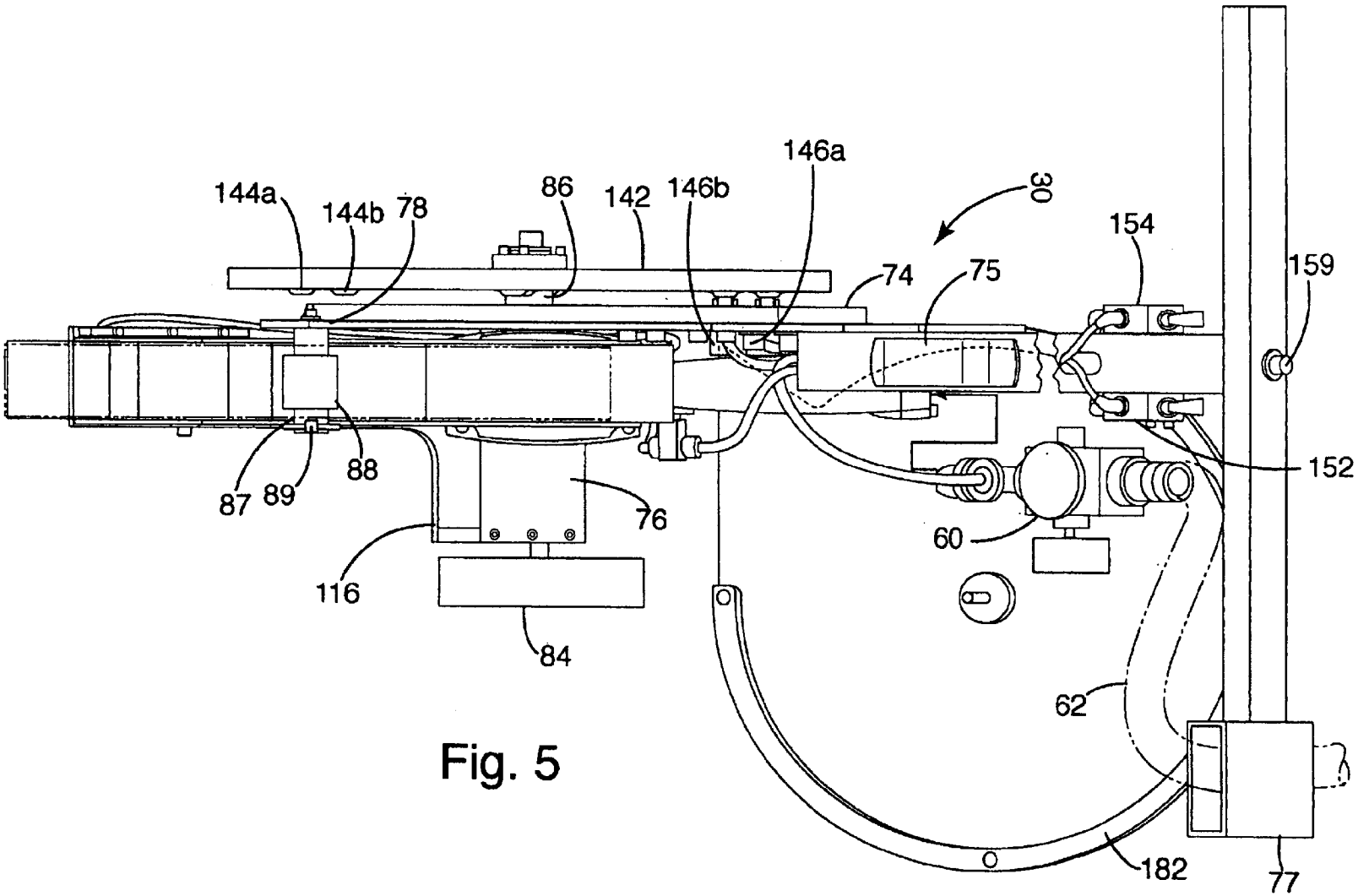
FIG. 5 is a top elevational view of the fastening system.

With further reference to FIGS. 3–5, the second member 78 of frame 70 includes a spool axle 87 at one end for mounting a spool of wound collated fastener caps 160 to the fastening system 30. As best shown in FIG. 5, the spool axle 87 includes a spool guide 88, which engages rims of the spool 160 to keep the spool on the spool axle and allow it to freely spin thereon. A clip 89 may secure the spool 160 on the spool axle 87.

At the end of the second member 78 opposite the spool axle 87, a caster or wheel 84 may be disposed. Optionally, the roller 84 may be replaced with a stationary peg to prevent the fastening system 30 from rolling when positioned on an inclined surface. Optionally, a magazine support plate 182 may be secured to the end of the second member near the roller 84 to support a supply of nails to be fired by the fastener driver 50. The magazine support plate may be integral with or fastened to the second member 78 with conventional fasteners.

Figures 7, 7A, 7B:
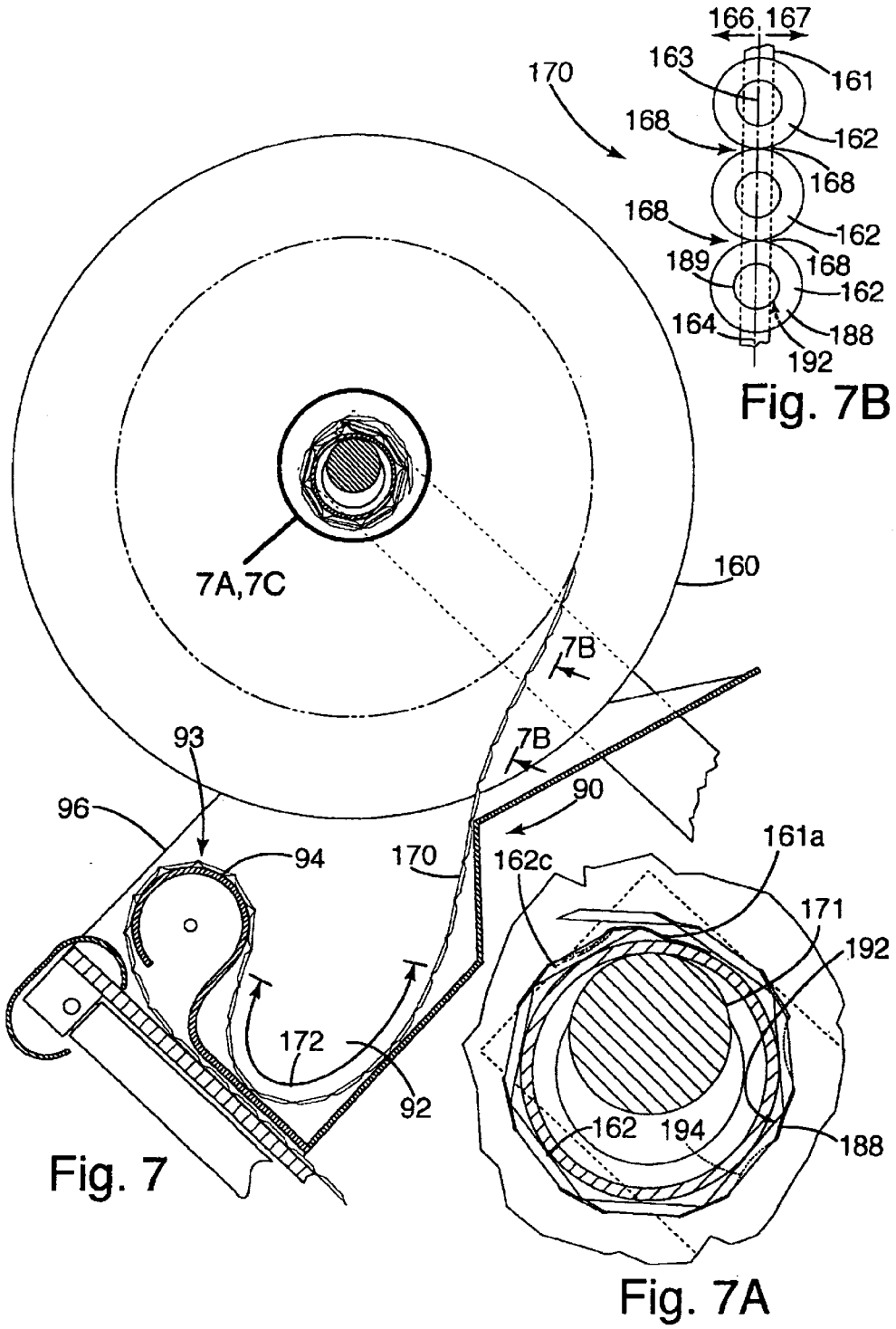
FIG. 7 is a right side elevational view of an accumulator of the fastening system.
FIG. 7A is a blown-up view of a spool of fastener caps.
FIG. 7B is a plan view of collated fastener caps.

With reference to FIGS. 7, 7A, 7B and 7C, the supply of fastener caps will now be described. The supply of fastener caps preferably is disposed on spool 160 in numbers ranging from 750–1500 caps per spool. The spool itself may be constructed of plastic, cardboard, metal or any other suitable material. Preferably, the fastener caps are formed of metal, but may be formed from any other material, for example, plastic, like the fastener caps sold by applicant under the trademark PLASTI-TOP. Where the fastener caps are metal, the metal may be pierceable and/or include a predefined hole to enable a fastener to be guided through the cap. Optionally, the plastic fastener caps also may include a predefined hole as desired. As used herein, "fastener cap" and "cap" may refer to fastener caps constructed from metal, plastic or any other material, or combinations thereof. The fastener caps 162 of the preferred embodiment as shown in FIGS. 7A and 7B are held together with a tape 161 having a low modulus of elasticity. The fastener caps are preferably positioned immediately adjacent one another, with a selected tolerance therebetween, on the strip of tape 161. The selected tolerance is of a length sufficient to permit one cap preferably to be twisted or rotated relative to an adjacent cap from about 2° to about 5°; more preferably from about 5° to about 6°; and most preferably from about 15° to about 20°, around the longitudinal axis 163, without breaking or severing the tape 161. More specifically, the tolerance between the tape is from a preferred lower limit of about 0.01 mm (millimeter); more preferably about 0.1 mm; and most preferably about 1.0 mm to an upper limit of preferably about 5.0 mm; more preferably about 2.0 mm; and most preferably about 1.1 mm.

Additionally, the tape 161 is constructed so that when a fastener is driven through a fastener cap 162, as shown in FIG. 8, the force exerted by the edge 164 of the cap 162 severs or snaps the tape 161. The tape preferably is a masking tape that is strong enough to allow at least a three pound pull on the tape without breaking so that the caps can be fed through the dispenser 110.

As shown in FIGS. 7A and 7B, individual fastener caps 162 are secured adjacent one another with the tape 161 to form a strip of collated fastener caps 170. The collated fastener caps 170 are generally divided down the center by longitudinal axis 163 into a first side 166 and a second side 167. Between the individual fastening caps 162, indexing openings 168 are formed. Each of the fastening caps 162 includes an upper side 188 and a lower side 192. The lower side is substantially concave, with the exception of a convex portion 194 extending therein. The upper side 188 is substantially convex, with the exception of a concave recess 189 adapted to guide a fastener through the cap. This concave recess coincides with the convex portion 194 on the lower side 192.

With further reference to FIG. 7A, a layering of the collated fastener caps 170 on spool 160 will now be described. A first cap 162*c* is taped with tape 161*a* to the core 171 of the spool 160. The tape 161*a* may either be an extension of masking tape 161 secured to the caps, twisted 180° and secured to the core, or a separate piece of tape attached to the first cap. Additional caps wrap around the spool core 171 counter-clockwise so that each succeeding concentric layer rests over the preceding layer. More preferably, the convex upper sides 188 of one layer fit within the concave lower sides 192 of the next overlaying concentric layer to maximize storage of spooled caps.

Figure 7C:
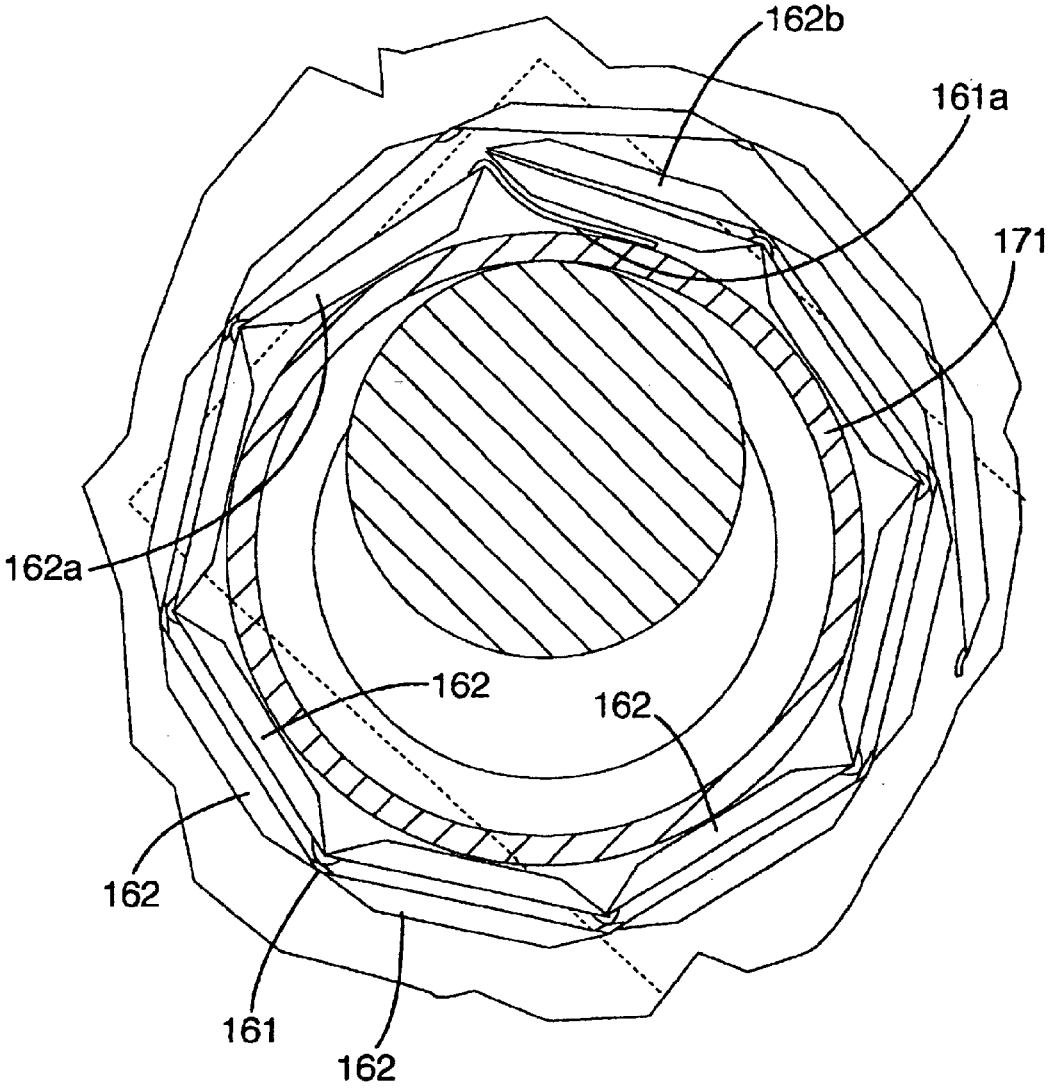
FIG. 7C is a blown-up view of an alternative spool of fastener caps.

In an alternative layering of the collated fastener caps shown in FIG. 7C, a first cap 162*a* is taped with tape 161*a* to the core 171 of the spool 160. Succeeding additional caps wrap around the spool core 171 counter clockwise. The fastener caps 162 immediately adjacent the core 171 of the spool 160 are positioned with the upper sides 188 in contact the core 171. If spool 160 cannot spin, the tape 161*a*, holding the first cap 162*a* to the core 171 breaks, allowing the first layer of caps adjacent the core 171 to freely spin on that core 161. Accordingly, the supply of collated fastener caps may continue to be dispensed from the spool 160. The succeeding or next concentric layer of fastener caps adjacent the first layer are positioned with the lower sides 192 facing toward the core 171. This layer starts with fastener cap 162*b*, which is doubled back over the first layer. This fastener cap may be held in place by a pin in the spool (not shown). Additional layers of collated caps are spooled onto the spool concave-down, like the second layer. In this configuration, like the preferred layering of the spool described above, the collated fastener caps 170 may be tightly wound because each preceding fastener cap layer rests within the concave-down portions of an overlaying layer.

C. Accumulator

An accumulator of the preferred embodiment of the present invention will now be described with reference to FIGS. 6 and 7. The accumulator 90 is generally mounted to the picker plate 116 under the supply spool 160 of collated fastener caps 170. The accumulator includes a bin or compartment 92 including an outlet 93. Located at or near the outlet 93 is a regulator 94. The bin 92 includes sidewalls 96 to form a storage space for excess supply of collated fastener caps 170. The regulator 94 generally includes a curved, or elliptical, or gently sloping surface over which collated fastener caps 170 from the spool 160 are draped. The collated fastener caps 170 may be pulled under the bin 92 by the fastener cap dispenser 110 (FIG. 3). The regulator 94 acts with gravity to prevent any excess portion of collated fastener caps from advancing toward the fastener cap dispenser 110 and jamming it. For example, if, in FIG. 7, the spool 160 of fastener caps is spun too quickly in a clockwise manner, then the regulator 94 prevents them from advancing toward the dispenser 160, and the excess collated fastener caps 172 simply drop by gravity into the compartment bin 92.

D. Fastener Cap Dispenser

FIGS. 3 and 8–12 illustrate a fastener cap dispenser 110 of the fastening system 30 of the preferred embodiment. The fastener cap dispenser 110 generally includes a picker plate 116, also referred to as a track, a drive cylinder 126, a picker 114, and a holding plate 122.

Figure 11:
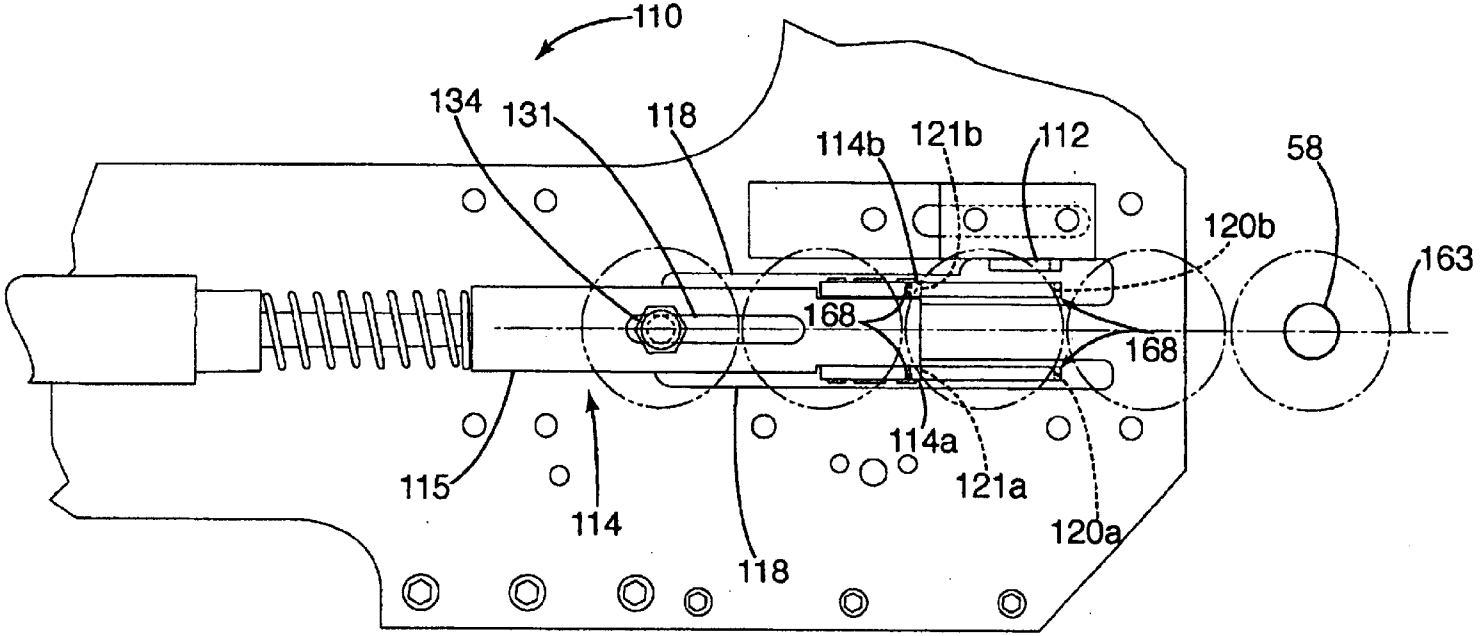
FIG. 11 is a bottom elevational view of the picker.
Figure 12:
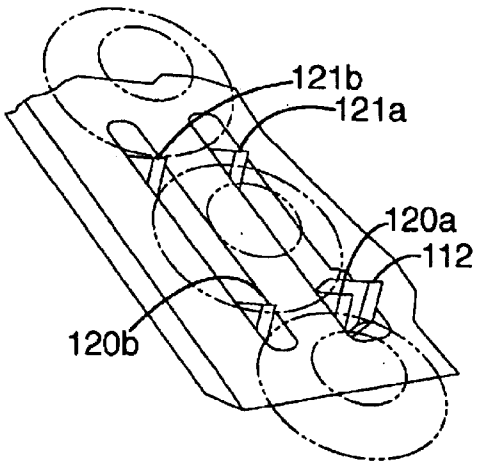
FIG. 12 is a perspective view of the picker.

The track defines a pair of parallel slots 118 in which portions of the picker 114 reciprocate. The picker 114 includes two plates 114*a*, 114*b* positioned on opposite sides of the picker member 115. Optionally, a wear plate 117 may be positioned between the track 116 and picker member 115 to decrease abrasion therebetween. The picker plates 114*a*, 114*b* include longitudinally spaced, upwardly extending teeth or "pawls," 120*a*, 120*b* and 121*a*, 121*b*, which slide in the slots 118. As shown in FIGS. 11 and 12, primary teeth 120*a*, 120*b* engage the indexing openings 168 of a first cap on opposite sides of the longitudinal axis 163 of the collated fastener caps. The secondary pair of teeth 121*a*, 121*b* engage the openings 168 of a second cap, adjacent the first washer, on opposite sides of the longitudinal axis 163. Thus, the picker is able to engage and advance two fastener caps simultaneously toward the barrel 58.

Figure 9:
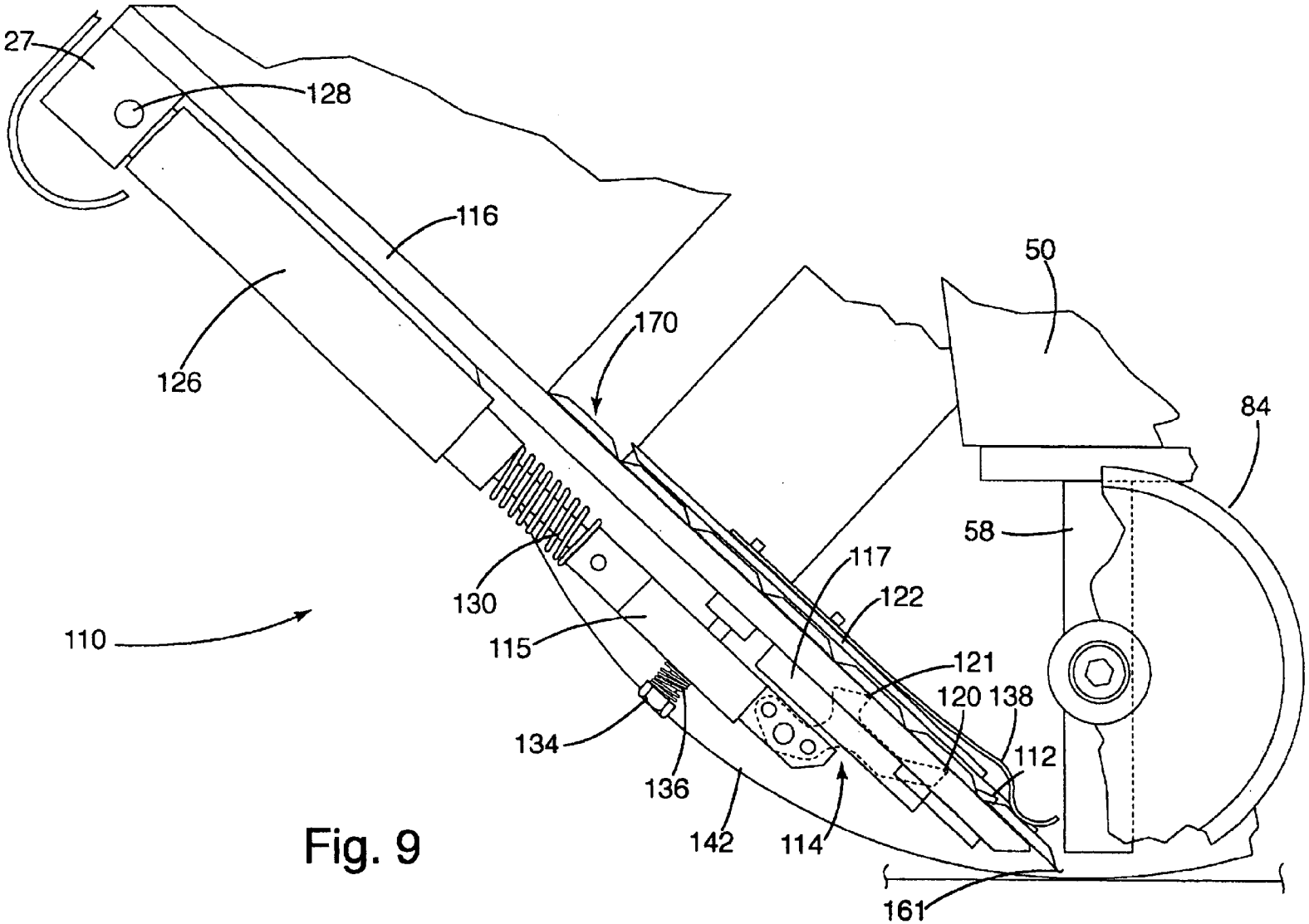
FIG. 9 is a right side elevational view of the picker in a partially retracted position.

The teeth 120*a*, 120*b* and 121*a*, 121*b* of the picker have vertical edges on a front side and beveled edges on a rear side. The beveled edges serve as cam surfaces and permit the teeth to ride under the fastener caps when the picker is retracted by the drive cylinder 126 as shown in FIG. 9.

In the preferred embodiment, much of the picker 114 is concealed under the track 116 and the track is disposed at an angle horizontal. With the configuration, most debris that lands on the track 116 simply tumbles off the track 116. The debris that falls through slots 118 is unlikely to contaminate picker 114 because it is concealed by the track.

A slot 131 is formed in the picker member 115 of the picker 114. A resilient attachment mechanism holds the picker member 115 downwardly, away from the track 116, as the picker 114 is pulled away from the barrel 58 in a reciprocating movement. The attachment mechanism includes bolt 134 that fits through slot 131 and is secured to the track 116 with a spring 136 positioned between the head of the bolt and the picker member 115, resiliently holding the picker member 115 against the wear plate 117. When the picker 114 is retracted, the teeth 120*a*, 120*b* and 121*a*, 121*b* travel downwardly and over the lower concave surfaces of the fastener caps 162, compressing the spring 136 against the bolt head. When the teeth encounter indexing openings in the collated fastener caps, the spring urges the picker member 114 upward to engage the teeth within corresponding indexing openings in the collated fastener caps.

The holding plate 122 holds the collated fastener caps 170 down against the track 116 so that as the picker member 115 is reciprocated, it does not move the collated fastener caps 170 away from the barrel 58 and/or drive path of the barrel 58.

Figure 10:
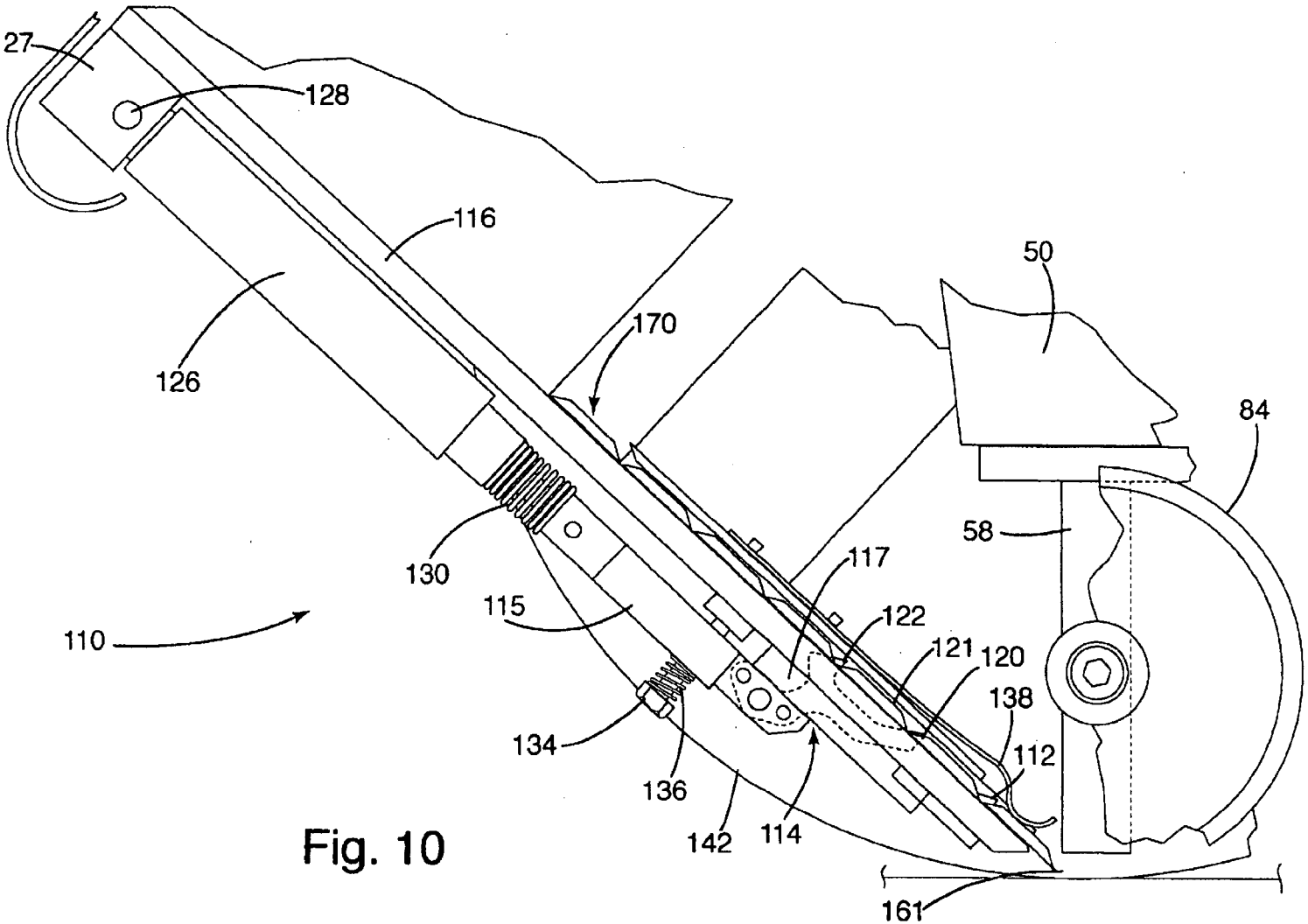
FIG. 10 is a right side elevational view of the picker in a retracted position.

As shown in FIGS. 8–10, the drive cylinder 126 is coupled to the picker member 115 for reciprocating the picker teeth within slots 118 (FIG. 11) defined in the track. The drive cylinder is mounted on flange 127 with a trunion mount. A bolt or shaft 128 extends through an opening in a fitting at the rear of the drive cylinder and permits the drive cylinder to rotate about the bolt 128. Thus, when the picker 114 rocks downwardly as the picker member 115 is retracted, the drive cylinder can pivot to accommodate the downward pivotal movement of the picker member 115.

Optionally, the fastener cap dispenser 110 includes a locator in the form of an indexing spring 138 that is mounted to the holding plate 122 with conventional fasteners. The indexing spring may include slotted openings that permit adjustment of the spring relative to the longitudinal axis of the collated fastener caps 170. The indexing spring preferably includes a convex head that engages the concave tops of independent fastening caps. The indexing spring holds the next-up fastening cap in place immediately before it is dispensed under the barrel 58 of the fastener driver 50. The indexing spring is deflected upward to permit the engaged fastener cap to be pushed into alignment with the fastener driver by the picker 114. The indexing spring also may include one or more downwardly extending anti-backup teeth or prongs that engage the next-up fastening cap or caps upstream of the next-up cap in the respective indexing openings to prevent those caps from advancing away from the barrel 58 of fastener driver 50.

Furthermore, the fastener cap dispenser 110 also may include a fixed tooth 112 positioned for engagement in the indexing opening 168 immediately upstream of the next-up fastener. The fixed tooth 112 may be secured to or fixed to the track 116. Preferably, the tooth 112 prevents the collator fastener caps 170 from receding from the barrel 58. Additional, similar teeth may be positioned for engagement in other indexing openings 168 adjacent any of the other fastener caps. For example, additional teeth may be positioned adjacent one or more of movable teeth 120*a*, 121*a* and 121*b* as desired. Furthermore, it will be appreciated that the fixed tooth 112 (or teeth) may be mounted on a spring or be deflectable, but not moveable in conjunction with the picker 114. These teeth, although not fixed, still prevent the collated fastener caps 170 from backing-away from the barrel 58 of the fastener driver 50. As used herein, "anti-backup tooth" refers to a fixed tooth or any tooth or device that prevents the collated fastener caps from moving away from the barrel 58 as the caps are dispensed.

Figure 19:
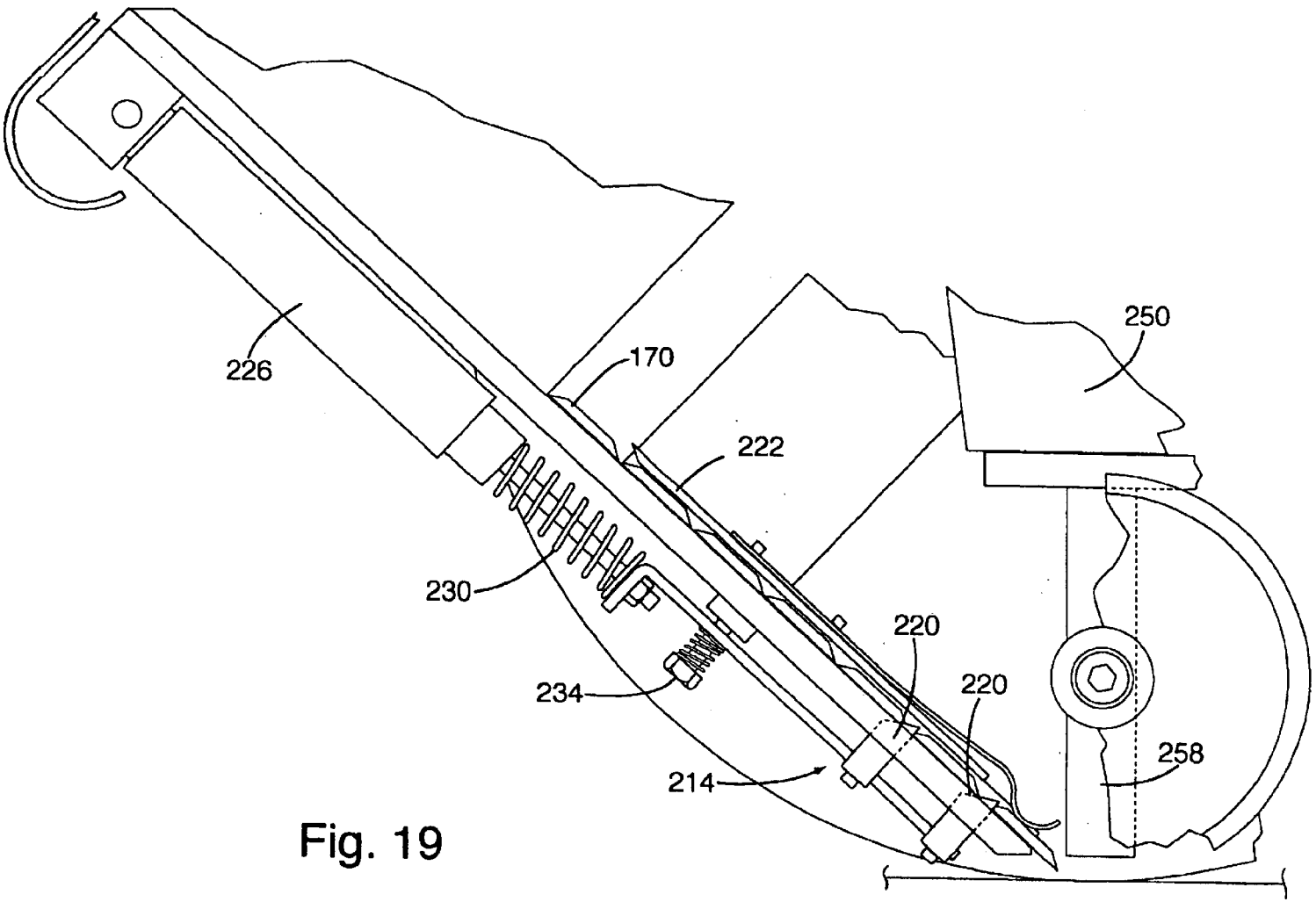
FIG. 19 is a right side elevational view of a first alternative embodiment of the fastener cap dispenser.
Figure 20:
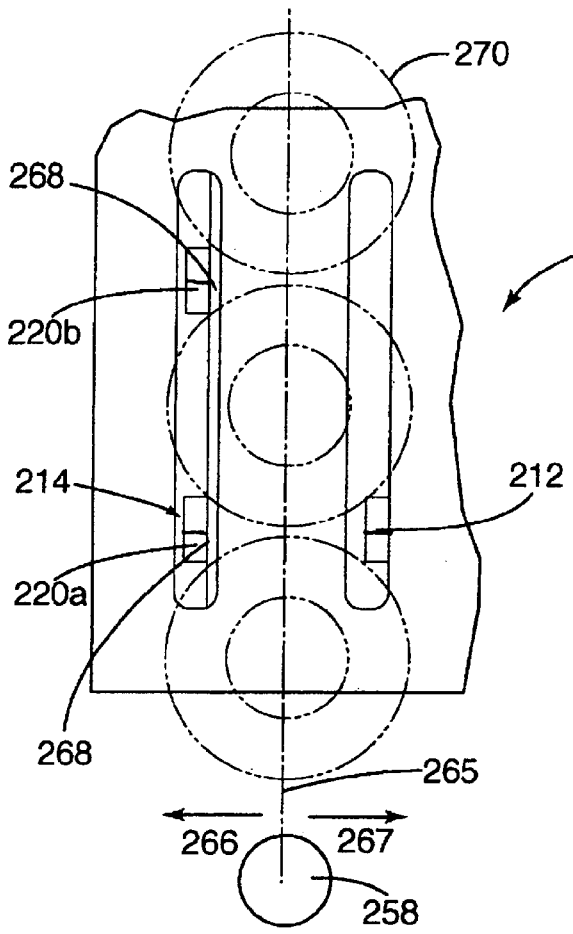
FIG. 20 is a top plan view of the first alternative fastener cap dispenser.

An alternative embodiment of the fastener cap dispenser, particularly the picker 214, is shown in FIGS. 19 and 20. In this embodiment, the picker includes two movable teeth 220. One movable tooth 220*a* is configured to engage a first indexing opening 268 on a first side 266 of the collated fastener caps 270 adjacent a first fastener cap of the collated fastener caps. A second tooth 220*b* is configured to simultaneously engage a second indexing opening 268, of an upstream fastener cap on the same side 266 of the collated fastener caps 270. Optionally, a fixed tooth 212 may be mounted to the track 216 on the second side 367 of the longitudinal axis 265 for a fixedly engaging an indexing opening 268 on that second side to prevent backing-up of the collated fastener caps 270.

Figure 21:
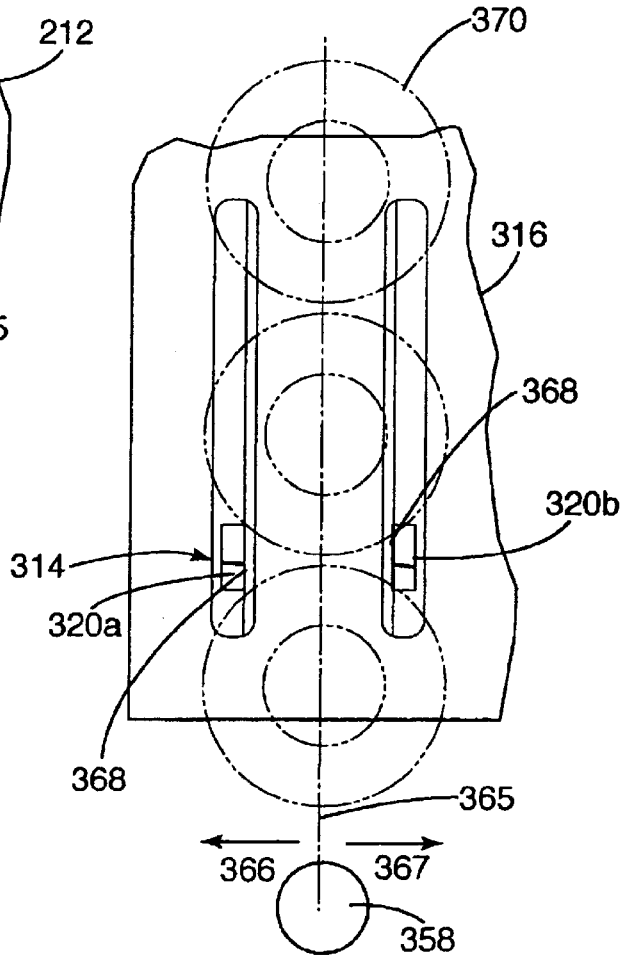
FIG. 21 is a top plan view of a second alternative embodiment of the fastener cap dispenser.

In a second alternative embodiment of the fastener cap dispenser shown in FIG. 21, the picker 314 includes two movable teeth 320 positioned for engagement in indexing openings 368 adjacent a single fastener cap on opposite sides 366 and 367 of the longitudinal axis of the collated fastener caps. Accordingly, the picker 314 advances the collated fastener caps 370 by engaging one fastening cap. Additional movable and/or fixed teeth may be added to the above embodiments as desired.

E. Actuator System

With reference to FIGS. 2–5 and 15, the actuator system 140 of the present invention will now be described. The actuator system generally includes an actuator wheel 142 including actuator elements 144*a*, 144*b*, actuators 146*a*, 146*b*, manual/auto control 152, interval control 154 and automatic 156 and manual 157 shuttle valves. Preferably, these components are in fluid communication with one another in a pneumatic system. However, such communication may be established using hydraulic, electrical and other systems, whether direct or remote, as desired.

As shown in FIGS. 2–5, the manual/auto control 152, interval control 154 and manual firing control 158 are mounted on the handle 72 of the fastening system 30. The actuators 146*a*, 146*b*, shown in FIG. 5, preferably are mounted to the first member with bolts, screws or other fastening means, and are in alignment with the actuator elements 144*a* and 144*b*, respectively.

Figure 6:
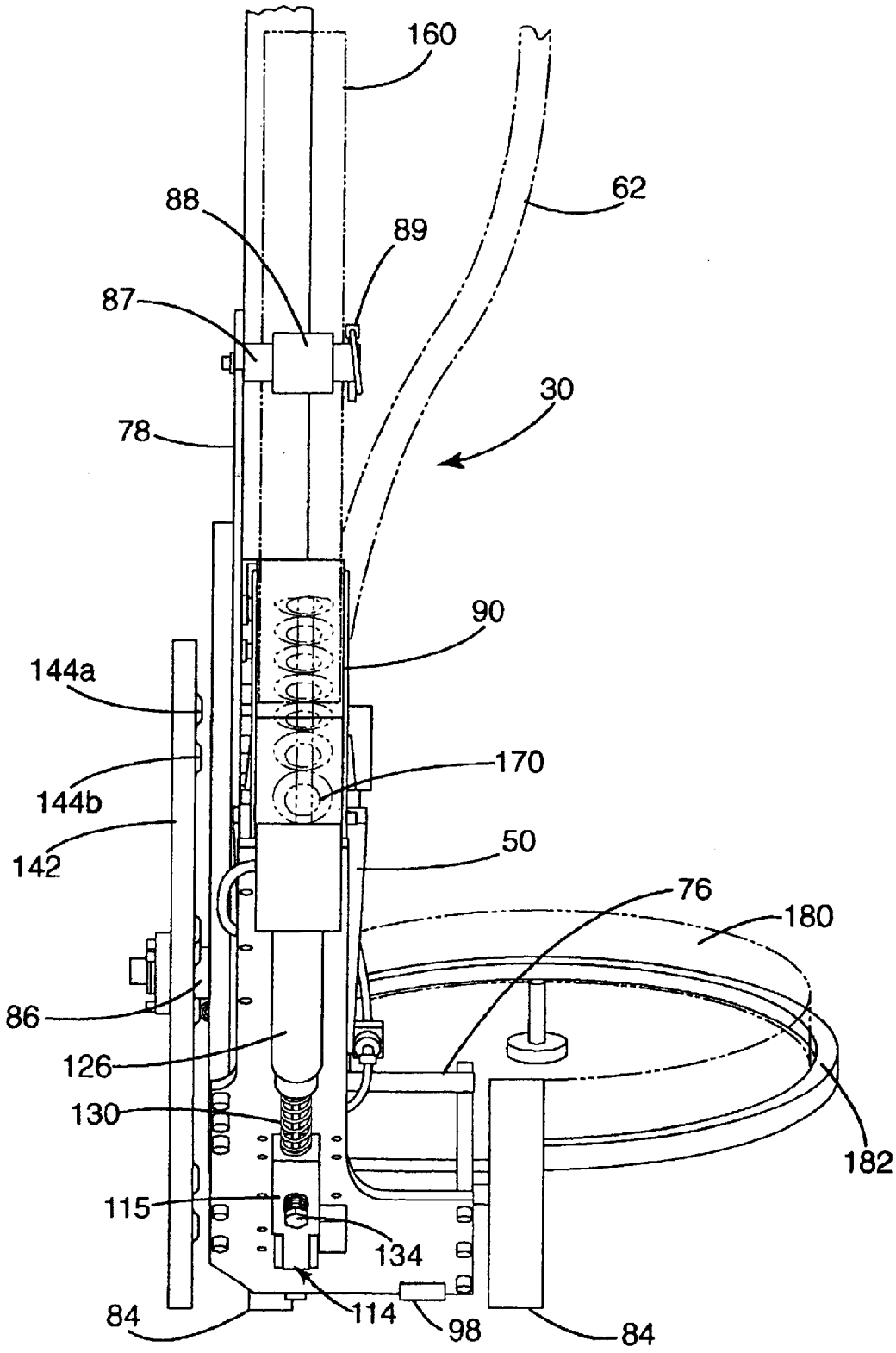
FIG. 6 is a front elevational view of the fastening system.

The actuator wheel 142 shown in FIGS. 4 and 6 is rotatably mounted to the chassis 70 via mounting axle 86. The actuator wheel includes actuating elements 144*a*, 144*b*, which travel in circular paths as the wheel 142 rotates. Preferably, the paths of the elements 144*a*, 144*b* are respectively aligned for communication with actuators 146*a*, 146*b*. The actuator elements preferably are bumps on the wheel, for example, bolts protruding from the wheel 142, that engage the actuators 146*a*, 146*b*. Optionally, recesses, teeth, prongs and/or detectable photodiodes or codes, e.g. bar codes, or electronic codes or chips embedded in the wheel, may be substituted for the bumps on the actuating wheel. Likewise, the actuators may be substituted with any corresponding detecting or reacting structure. As used herein, "actuator" means any device capable of detecting or reacting to an actuator element or any other mechanism for sensing rotation of the wheel. For example, the actuator elements may be replaced with multiple, encoded electronic microchips. The actuator may be a sensor that monitors the revolution of the wheel, and thus the distance traveled by the fastening system, by sensing the chips. This actuator element/actuator may be in communication with a control from which a user can select any interval, or combination of intervals, at which to actuate the fastening system 10 as desired.

Optionally, the actuator wheel, actuating elements, and actuator, may be substituted with or combined with a conventional stud finder or sensor 98. The sensor 98 may sense the substructure under a surface across which the fastening system travels and subsequently communicate with the fastener driver 50 to drive fasteners into the surface in areas where a substructure is located so the fastener is driven into the substructure.

Preferably, the actuator elements 144*a*, 144*b* are positioned on the actuator wheel 142 at preselected positions, corresponding to degrees of rotation of the actuator wheel, so that the actuator wheel actuates the actuators at regular intervals, for example, every 9 or 18 inches. The circumference of the actuator wheel preferably is divisible by the selected intervals at which it is desired to actuate the actuators 146*a*, 146*b* and fire the fastener driver 50. For example, where it is desired to actuate (1) the actuator 146*a* once every 9 inches that the fastening system 30 travels and (2) the other actuator 146*b* every 18 inches that the fastening system 30 travels, the circumference of the actuator wheel is 36 inches, which is divisible by both 9 inches and 18 inches. The circumference of the actuator wheel may vary as desired. For example, a 24 inch circumference actuator wheel may be used where 4 inch, 6 inch or 12 inch intervals are desired.

Preferably, both actuators 146*a*, 146*b* are in fluid communication with interval shuttle valve 156. This interval shuttle valve 156 is in fluid communication with manual/auto shuttle valve 157, which is in fluid communication with the trigger actuator 56.

Figure 13:
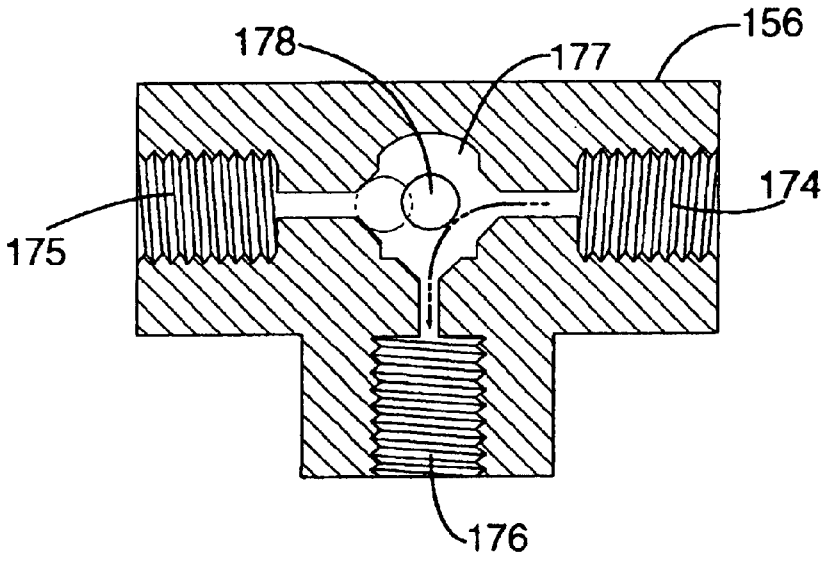
FIG. 13 is a cross-sectional view of a shuttle valve of an actuator system of the present invention.

The interval and manual/auto shuttle valves of the present invention are shown in FIG. 13. The shuttle valve 156 generally includes a first inlet 174, second inlet 175, outlet 176, internal cavity 177 and check ball 178. The shuttle valve allows fluid to flow from one inlet to the outlet, but prevents fluid from flowing from the one inlet to the other inlet. As shown in FIG. 13, if fluid is incoming from inlet 174, then the check ball 178 sealably engages against the second inlet 175 to prevent air from entering that inlet. Thus, air is diverted out from the shuttle valve 156 through the outlet 176. Other commercially available valves that provide two or more inlets and divert fluid to only one outlet may be substituted for the shuttle valve shown in the FIG. 13. In alternative actuator systems including fewer or no different operating modes, shuttle valves may be absent altogether. For example, in an actuator system including only one mode of operation, no shuttle valves may be present.

Each of the 9 inch actuator valve 146*a* and 18 inch actuator valve 146*b* also are in fluid communication with the interval control 154. The interval control 154 is a diverter valve that diverts incoming air from the manual/auto control outlet into either the 9 inch actuator valve or the 18 inch actuator, depending on the position of the diverter 154. Likewise, the manual/auto control 152 diverts incoming air from the manual firing control 158 to either the interval control 154 or the manual/auto shuttle valve 157.

Figure 15:
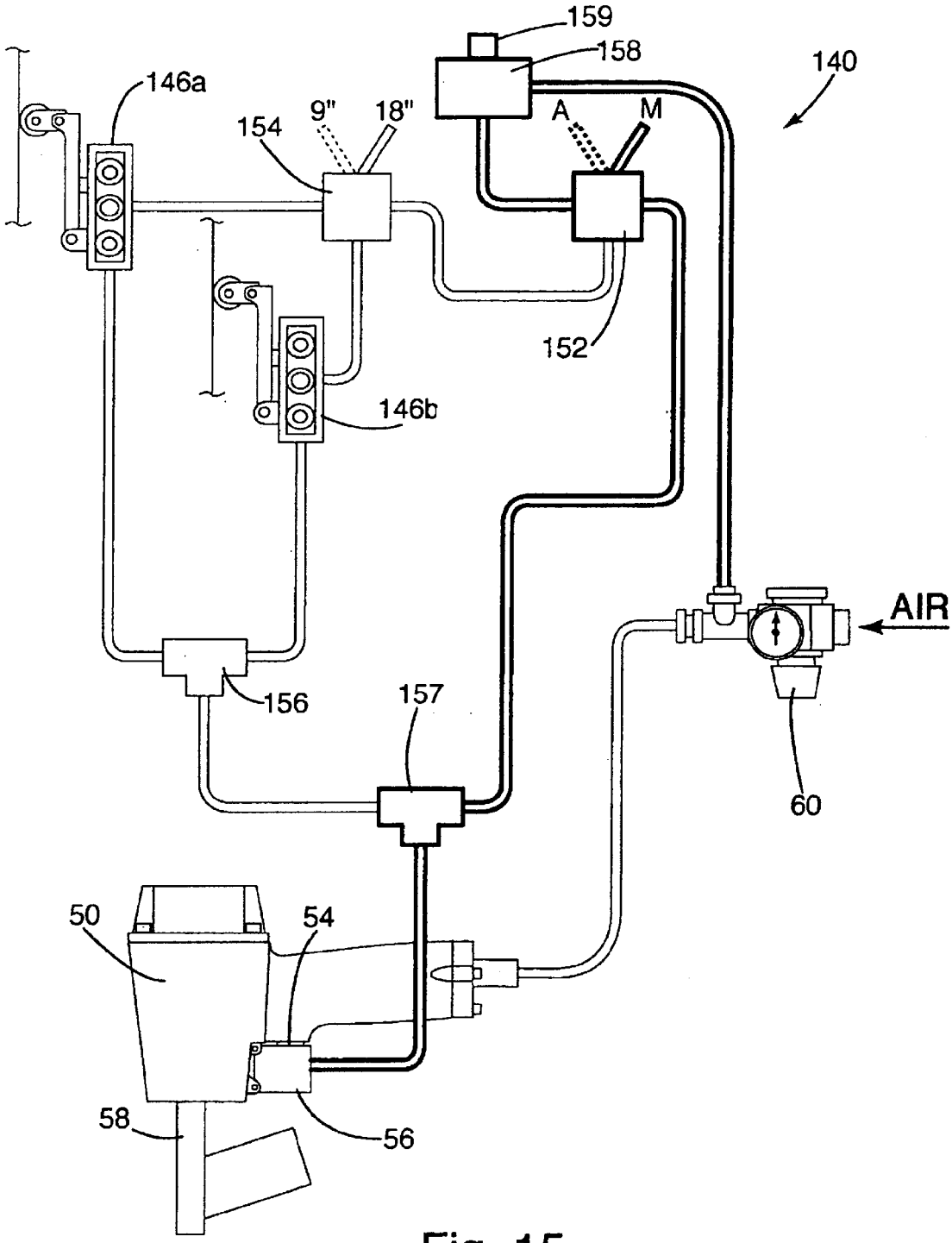
FIG. 15 is a schematic of an actuator system of the fastening system in a manual mode.

The actuator system shown in FIG. 15 is generated under incoming compressed air, regulated in the system by the pressure regulator 60. Under a high-speed operating environment, it may be desirable to circulate oil to the fastener driver 50 to improve lubrication of its internal drive mechanism. However, it has been discovered that if the oil is provided through the pressure regulator 60 as shown in FIG. 15, the oil also tends to coat the working surfaces of the actuators 146*a*, 146*b*. After continued use, the oil may attract debris, for example, sand, which sticks to the working elements of these actuators causing the actuators to malfunction. Thus, optionally, as shown in FIG. 18, the actuator system may be plumbed so that the oil is dispensed only to fastener driver 50. To do so, air is first bled-off the pressure regulator 260 to the primary actuator system airline 202. A second stream of air diverts through the air oiler 200 and to the fastener driver 250. Accordingly, oil is prevented from intermixing with the air supply provided through the air supply line 286 to the remainder of the actuator system 140.

II. Operation

The operation of the fastening system of the present invention will now be described. Generally, when the fastening system 30 of the present invention is rolled across a surface, the actuator wheel 142 rotates to engage actuators 146*a*, 146*b*. Pressurized air is transferred from the engaged actuators to a trigger actuator 56, which activates the trigger assembly 54 of the fastener driver 50, causing the fastener driver to drive a nail out its barrel 58. Drive air is vented-off the fastener driver 50 to the fastener cap dispenser 110 to reciprocate the picker 114 and thereby advance a fastener cap into the firing path of the barrel 58. As the actuator wheel continues to rotate, the process is repeated with a fastener being driven through the last-dispensed fastener cap.

Figure 16:
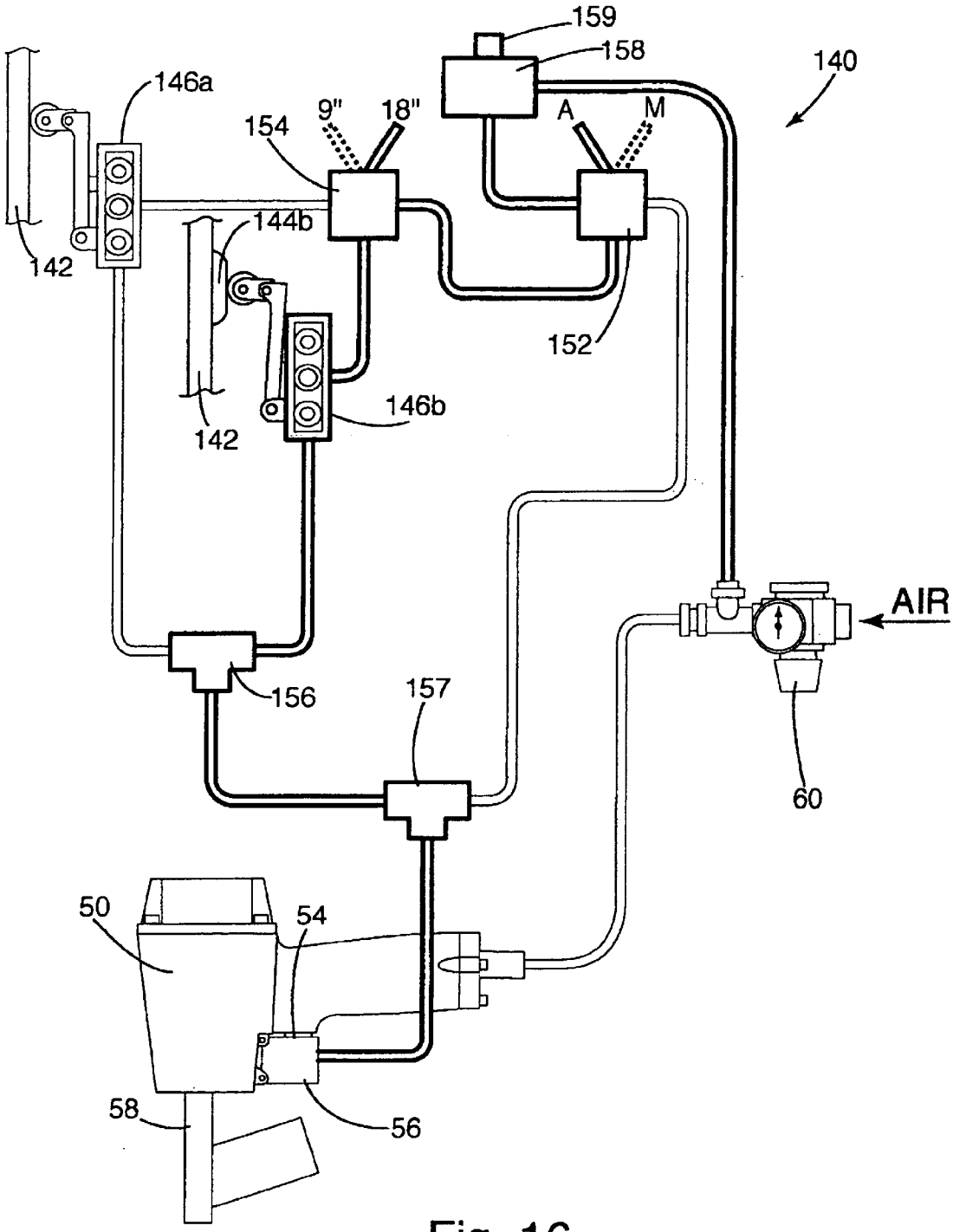
FIG. 16 is a schematic of the actuator system in an automatic mode with a first discharging interval selected.
Figure 17:
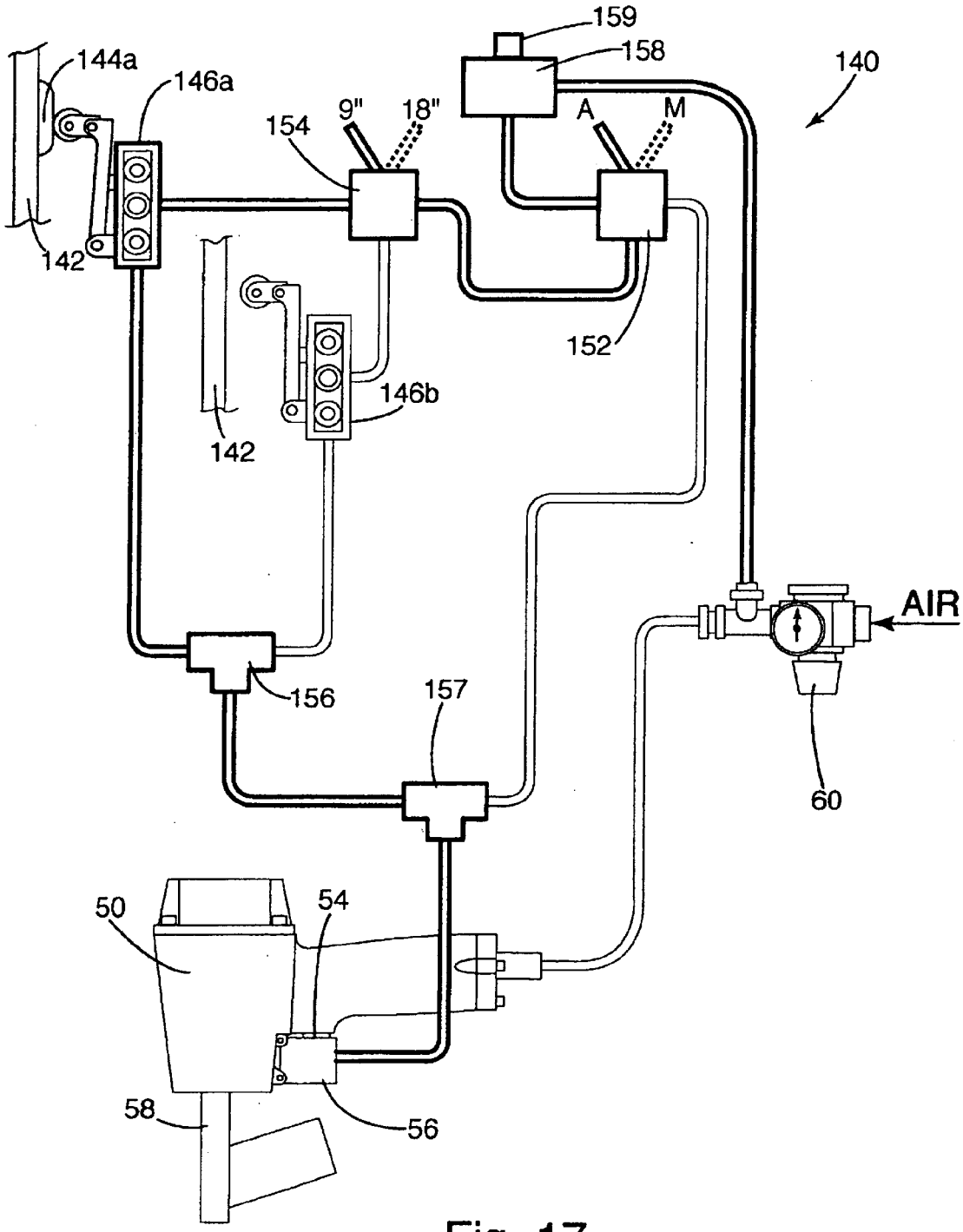
FIG. 17 is a schematic of an actuator system in an automatic mode with a second discharging interval selected.

More particularly, the actuator system 140 and fastener driver 50 of the fastening system 30 are initially pressurized with compressed air, which is fed through the regulator 60. With reference to FIGS. 15–17, operation under several modes will now be described. As shown in FIG. 15, the actuator system is in a user-selected manual mode when the manual/auto control 152 also referred to as a "mode switch," is in the "M" position. In this mode, the user may fire a fastener through a fastener cap at any chosen interval. When an operator depresses the button 159 of manual firing control 158, also referred to as a "manual switch," the pressurized air travels the bolded route to actuate the fastener driver 50, thereby driving a nail from the barrel 58 as best shown in FIG. 3. Specifically, fluid communication is established between the manual firing control 158, the manual/auto control 152, manual/auto shuttle valve 157 and the trigger actuator 56. The trigger actuator 56 activates the trigger assembly 54 of the fastener driver 50, thereby firing a fastener from the barrel 58.

Drive air is diverted through drive air diverter 68 (FIG. 3) to the drive cylinder 126 of the fastener cap dispenser 110. With reference to FIGS. 8–10 the drive air causes the picker 114 to reciprocate. As shown in FIG. 9, the picker is initially beginning to reciprocate, and the teeth 120 and 121 are pulled under the collated fastener caps 170 until they are positioned as shown in FIG. 10. There, the spring 136 has biased the picker 114 upward, and the teeth are positioned upstream from their original position in engagement with the indexing openings of the next two fastener caps. Additionally, the drive spring 139 has been compressed between the picker 114 and the drive cylinder. At this point, the compressed spring decompresses, driving the picker 114 away from the drive cylinder 126 and causing the collated fastener caps 170 to advance toward the barrel 58 of the fastener driver 50. The previous next-up fastener cap is deposited directly in the drive path of the barrel 58. As the fastening system 10 is pushed along, the previous next-up fastener cap floats (and in some cases, is dragged) under the barrel 58, until, as shown in FIG. 15, the operator again depresses the button 159, and a fastener is driven out the barrel 58 through that fastener cap to repeat the process described above.

As shown in FIG. 15, the collated fastener caps 110 preferably are advanced in a direction that is substantially opposite from the direction of movement of the fastening system 10 (e.g., about 180° opposite), although other directions of advancement may be chosen as desired. For example, the fastening caps may be advanced in a direction between about 170° and about 190° opposite to the direction that the fastening system 10 moves.

FIG. 16 shows the actuator system 140 in a first user-selected automatic mode when the manual/auto control 152 is in the "A" position and the interval control 154, also referred to as a "distance selection switch," is in the "18 inch" position. In this mode the fastener driver system 30 is able to automatically discharge fasteners from the fastener driver 50 through fastener caps every time the fastener driver 30 is moved 18 inches. As shown in the diagram, fluid communication is established between the air pressure regulator 60, the manual firing control 158, the manual/auto control 152, the interval control 154 and the 18 inch actuator 146*b*. When the actuator 146*b* is actuated by engagement with the actuator element 144*b* on the actuator wheel 142, fluid communication is further established between the 18 inch actuator, the interval shuttle valve 156, the manual/auto shuttle valve 157 and the trigger actuator 56. When this fluid communication is established, the trigger actuator depresses the trigger assembly 154 of the fastener driver 50, thereby driving a nail from the barrel 58. Diverted drive air actuates the fastener cap dispenser 110 to dispense another fastener cap, in the manner described above in the manual mode. This process is repeated as the fastening system 130 is rolled across a surface, thereby driving nails through fastener caps and into the surface every 18 inches in the manner described above.

FIG. 17 shows the actuator system 140 in a second user-selected automatic mode when the manual/auto control 152 is in the "A" position and the interval control 154 is in the "9 inch" position. In this mode, the fastener driver system 30 is able to discharge fasteners from the fastener driver 50 at 9 inch intervals. As shown in the diagram, fluid communication is established between the air pressure regulator 60, the manual firing control 158, the manual/auto control 152, the interval control 154 and the 9 inch actuator 146*a*. When the actuator 146*b* is actuated by engagement with the actuator element 144*a* on the actuator wheel 142, fluid communication is further established between the 9 inch actuator, the interval shuttle valve 156, the manual/auto transfer shuttle valve 157 and the trigger actuator 56. When this fluid communication is established, the trigger actuator 156 depresses the trigger assembly 154 of the fastener driver, thereby driving a nail from the barrel 58. Diverted drive air actuates the fastener cap dispenser 110 to dispense another fastener cap. This process is repeated as the fastening system 130 is rolled across a surface, thereby driving nails through fastener caps and into the surface every 9 inches in the manner described above.

With the actuator system of the present invention, a user may select between manual and automatic modes above by moving the manual/auto control 152 to the desired setting. This selection may be made as the fastening system 30 is moved along a surface. Moreover, a user may select between 9 inch and 18 inch driving intervals as the fastening system is moved along a surface by adjusting the interval control 154 to the desired position.

The above descriptions are those of the preferred embodiments of the invention. Various alterations and changes can be made without departing from the spirit and broader aspects of the invention as defined in the appended claims, which are to be interpreted in accordance with the principles of patent law including the doctrine of equivalents. Any references to claim elements in the singular, for example, using the articles "a," "an," "the," or "said," is not to be construed as limiting the element to the singular.

What is claimed is:

1. A fastening system comprising:

a mobile chassis adapted to advance in a first direction;

drive means for driving a fastener along a path into a work piece, said drive means mounted to the chassis;

fastener cap storing means for storing a supply of collated fastener caps, said collated fastener caps formed in a string having a longitudinal axis, said fastener caps cooperating to define a plurality of indexing openings adjacent each of the fastener caps, said fastener cap storing means mounted to said chassis;

dispensing means for dispensing the collated fastener caps one-by-one in a second direction that is substantially opposite said first direction and into said path, said dispensing means mounted to said chassis; and an actuator system coupled to the chassis that actuates said drive means to drive a fastener along said path through a fastener cap.

2. A fastening system comprising:

a chassis;

a wheel rotatably mounted to said chassis including at least one actuating element that travels in a first path;

drive means for driving a fastener along a second path into a work piece, said drive means mounted to the chassis;

fastener cap storing means for storing a supply of collated fastener caps, said fastener cap storing means mounted to said chassis;

dispensing means for dispensing the collated fastener caps one-by-one into said second path, said dispensing means mounted to said chassis; and an actuator system coupled to said chassis including an actuator valve disposed along or adjacent said first path and adapted to be engaged by said actuating element whereby said actuator system actuates said drive means to drive a fastener along said second path through a fastener cap;

wherein said actuating element engages said actuator valve at intervals corresponding to a degree of rotation traversed by said wheel.

3. A fastening system comprising:

a mobile chassis;

drive means for driving a fastener along a path into a work piece, said drive means mounted to the chassis;

fastener cap storing means for storing a supply of collated fastener caps, said fastener cap storing means mounted to said chassis;

dispensing means for dispensing the collated fastener caps one-by-one into said path, said dispensing means mounted to said chassis;

an actuator system coupled to the chassis that actuates said drive means to drive a fastener along said path through a fastener cap; and accumulation means for feeding said collated fastener caps to said dispensing means at a constant rate to prevent said collated fastener caps from jamming in said dispensing means.

4. A fastening system comprising:

a mobile chassis adapted to advance in a first direction;

drive means for driving a fastener along a path into a work piece, said drive means mounted to the chassis;

fastener cap storing means for storing a supply of collated fastener caps, said fastener cap storing means mounted to said chassis, wherein the collated fastener caps are formed in a string, said string defining a longitudinal axis having a first side and a second side opposite said first side relative to said longitudinal axis and wherein the fastener caps cooperate to form a plurality of indexing opens being disposed on the first and second sides of the longitudinal axis, with at least one of the indexing openings being adjacent each of the fastener caps;

dispensing means for dispensing the collated fastener caps one-by-one in a second direction substantially opposite said first direction, into said path, said dispensing means mounted to said chassis; and an actuator system coupled to the chassis that actuates said drive means to drive a fastener along said path through a fastener cap;

wherein the dispensing means includes a first pair of reciprocating feed teeth for engagement in the indexing openings for advancing the collated fastener caps toward the path, with a first tooth of said first pair of feed teeth being disposed in a first indexing opening on the first side of the longitudinal axis, adjacent a first fastener cap to be advanced, and a second tooth of the first pair of feed teeth being disposed in a second indexing opening on the first side of the longitudinal axis, adjacent a second fastener cap immediately following the first fastener cap, as the collated fastener caps are advanced toward the path.

5. The fastening system of claim 4 wherein the dispensing means includes a second pair of reciprocating feed teeth for engagement in the indexing openings for advancing the collated fastener caps toward the path, with a third tooth of said second pair of feed teeth being disposed in a third indexing opening on the second side of the longitudinal axis, adjacent the first fastener cap to be advanced, and a fourth tooth of the second pair of teeth being disposed in a fourth indexing opening on the second side of the longitudinal axis, adjacent the second fastener cap immediately following the first fastener cap, as the collated fastener caps are advanced toward the path.

6. The fastening system of claim 5 comprising an anti-backup tooth for engagement in at least one of the first indexing opening, the second indexing opening, the third indexing opening and the fourth indexing opening to prevent the collated fastener caps from moving away from the path as at least one of the first pair and second pair of reciprocating feed teeth reciprocate.

7. The fastening system of claim 5 wherein the dispensing means includes a second pair of anti-backup teeth for engagement in the indexing openings for preventing the collating fastener caps from backing away from the path when the first pair of reciprocating feed teeth advance the collated fastener caps towards the path, with a third anti-backup tooth of said second pair of anti-backup teeth being disposed in a third indexing opening on the second side of longitudinal axis, adjacent the first fastener cap to be advanced, and a fourth anti-backup tooth of the second pair of anti-backup teeth being disposed in a fourth indexing opening on the second side of the longitudinal axis, adjacent the second fastener cap immediately following the first fastener cap.

8. A fastening system comprising:

a mobile chassis;

drive means for driving a fastener along a path into a work piece, said drive means mounted to the chassis;

fastener cap storing means for storing a supply of collated fastener caps, said fastener cap storing means mounted to said chassis, wherein the collated fastener caps are formed in a string, said string defining a longitudinal axis having a first side and a second side opposite said first side relative to said longitudinal axis and wherein the fastener caps cooperate to form a plurality of indexing opens being disposed on the first and second sides of the longitudinal axis, with at least one of the indexing openings being adjacent each of the fastener caps;

dispensing means for dispensing the collated fastener caps one-by-one into said path, said dispensing means mounted to said chassis;

an actuator system coupled to the chassis that actuates said drive means to drive a fastener along said path through a fastener cap; and an anti-backup tooth for engagement in at least one of the indexing openings to prevent the collated fastener caps from moving away from the path.

9. A fastening system comprising:

a mobile chassis;

drive means for driving a fastener along a path into a work piece, said drive means mounted to the chassis;

fastener cap storing means for storing a supply of collated fastener caps, said fastener cap storing means mounted to said chassis, wherein the collated fastener caps are formed in a string, said string defining a longitudinal axis having a first side and a second side opposite said first side relative to said longitudinal axis and wherein the fastener caps cooperate to form a plurality of indexing opens being disposed on the first and second sides of the longitudinal axis, with at least one of the indexing openings being adjacent each of the fastener caps;

dispensing means for dispensing the collated fastener caps one-by-one into said path, said dispensing means mounted to said chassis; and an actuator system coupled to the chassis that actuates said drive means to drive a fastener along said path through a fastener cap;

wherein the dispensing means includes a first pair of reciprocating feed teeth for engagement in the indexing openings for advancing the collated fastener caps toward the path, with a first tooth of said first pair of feed teeth being disposed in a first indexing opening on the first side of the longitudinal axis, adjacent a first fastener cap to be advanced, and a second tooth of the first pair of feed teeth being disposed in a second indexing opening on the second side of the longitudinal axis, adjacent said first fastener cap to be advanced, as the collated fastener caps are advanced toward the path.

10. A fastening system comprising:

a chassis;

a wheel rotatably mounted to said chassis including at least one actuating element that travels in a first path;

drive means for driving a fastener along a second path into a work piece, said drive means mounted to the chassis;

fastener cap storing means for storing a supply of collated fastener caps, said fastener cap storing means mounted to said chassis;

dispensing means for dispensing the collated fastener caps one-by-one into said second path, said dispensing means mounted to said chassis;

an actuator system coupled to a chassis including an actuator valve disposed along or adjacent said first path and adapted to be engaged by said actuating element whereby said actuator system actuates said drive means to drive a fastener along said second path through a fastener cap; and wherein the actuator system is operable in at least one of an automatic mode, in which the actuator valve is activated so that when the actuator valve is engaged by the actuating element, the drive means drives the fastener, and a manual mode, in which the actuator valve is deactivated so that the drive means is prevented from driving a fastener when the actuator valve is engaged by the actuating element.

11. The fastening system of claim 10 comprising a control to allow a user to select between the automatic mode and the manual mode as the chassis is moved by a user along a support surface.

12. A device for driving fasteners through caps at spaced locations comprising:

a rolling chassis that rolls in a first direction; dispensing means for dispensing caps sequentially, in a second direction that is generally opposite said first direction, to a ready position;

driving means for driving a fastener through the cap in the ready position and into a substrate;

determining means for determining when the chassis has moved a preselected distance; and actuator means responsive to said determining means for actuating both said driving means and said dispensing means each time that said chassis has moved the preselected distance.

13. A device as defined in claim 12 further comprising a manual switch, said actuator means also being responsive to said switch for actuating both said driving means and said dispensing means each time that said switch is actuated.

14. A device as defined in claim 13 further comprising a mode switch, said actuator means being responsive to said determining means only when said mode switch is in a first position, said actuator means being responsive to said manual switch only when said mode switch is in a second position.

15. A device as defined in claim 12 further comprising:

a second determining means for determining when the chassis has moved a second preselected distance; and a distance-selection switch, said actuator means being responsive to said first determining means when said distance-selection switch is in a first position, said actuator means being responsive to said second determining means when said distance-selection switch is in a second position.

16. A device for driving fasteners through fastening caps comprising:

a rolling chassis adapted to move in a first direction;

dispensing means for advancing caps in a second direction, said second direction substantially opposite said first direction, said caps formed in a string having a longitudinal axis, said fastener caps cooperating to define a plurality of indexing openings adjacent each of the fastener caps, and for dispensing the caps in a ready position; and a drive means for driving a fastener through a cap when the cap is in the ready position.

17. The device of claim 16 comprising actuating means to actuate the drive means.

18. The device of claim 17 comprising a sensor adapted to sense substructures under a surface upon which the rolling chassis moves.

19. The device of claim 18 wherein the sensor communicates with the actuating means when the sensor detects a substructure whereby the drive means driver fastener.

20. The device for driving fasteners through fastening caps of claim 16 wherein said second direction is generally between about 170° and about 190° opposite said first direction.

21. The device for driving fasteners through fastening caps of claim 20 wherein said second direction is about 180° opposite said first direction.

22. A fastening system comprising:

a rolling chassis that advances in a first direction;

dispensing means for dispensing individual fastener caps from a collated fastener cap supply in a second direction that is substantially opposite said first direction, said collated fastener cap supply including fastener caps formed in a string having a longitudinal axis, said fastener caps cooperating to define a plurality of indexing openings adjacent each of the fastener caps;

a drive means for driving a fastener through a dispensed fastener cap into a surface upon which the rolling chassis moves;

sensing means for sensing a substructure under said surface, said sensing means mounted to said rolling chassis; and actuating means, in communication with said sensing means, for actuating the drive means when said sensing means senses the substructure.

* * * * *